US009265359B2

(12) United States Patent
Wood et al.

(10) Patent No.: US 9,265,359 B2
(45) Date of Patent: Feb. 23, 2016

(54) REFRIGERATED DISPLAY APPLIANCES

(75) Inventors: Ian Wood, Suffolk (GB); Edward Hammond, Suffolk (GB)

(73) Assignee: Applied Design and Engineering Ltd., Lowestoft, Suffolk (GB)

( * ) Notice: Subject to any disclaimer, the term of this patent is extended or adjusted under 35 U.S.C. 154(b) by 395 days.

(21) Appl. No.: 13/638,297

(22) PCT Filed: Mar. 29, 2011

(86) PCT No.: PCT/GB2011/000474

§ 371 (c)(1),
(2), (4) Date: Sep. 28, 2012

(87) PCT Pub. No.: WO2011/121284

PCT Pub. Date: Oct. 6, 2011

(65) Prior Publication Data

US 2013/0019621 A1 Jan. 24, 2013

(30) Foreign Application Priority Data

| | | |
|---|---|---|
| Mar. 29, 2010 | (GB) | 1005276.9 |
| Mar. 29, 2010 | (GB) | 1005277.7 |
| Mar. 29, 2010 | (GB) | 1005285.0 |
| Mar. 29, 2010 | (GB) | 1005286.8 |

(51) Int. Cl.
*A47F 3/04* (2006.01)

(52) U.S. Cl.
CPC ..... *A47F 3/0447* (2013.01)

(58) Field of Classification Search
CPC .... A47F 3/0439; A47F 3/0443; A47F 3/0447
USPC ..... 62/126, 186, 246, 255, 256
See application file for complete search history.

(56) References Cited

U.S. PATENT DOCUMENTS

| | | | | |
|---|---|---|---|---|
| 3,063,256 | A | 11/1962 | Lamb | |
| 3,771,323 | A * | 11/1973 | Simons et al. | 62/89 |
| 5,357,767 | A * | 10/1994 | Roberts | 62/256 |
| 5,475,987 | A | 12/1995 | McGovern | |
| 2002/0162346 | A1 * | 11/2002 | Chiang et al. | 62/246 |
| 2003/0217560 | A1 | 11/2003 | Kasuya et al. | |

(Continued)

FOREIGN PATENT DOCUMENTS

| | | | |
|---|---|---|---|
| EP | 0589783 | A1 | 3/1994 |
| FR | 2690825 | A1 | 11/1993 |

(Continued)

OTHER PUBLICATIONS

International Search Report and Written Opinion dated Jan. 31, 2012 pertaining to PCT/GB2011/000474.

*Primary Examiner* — Marc Norman
(74) *Attorney, Agent, or Firm* — Dinsmore & Shohl LLP

(57) ABSTRACT

A refrigerated display unit (1), having an open-fronted cabinet providing a product display space (3) accessible through an access opening (39) provided by the open front. Cooling means (27) produces cold air to refrigerate items in the product display space (3). A cold air curtain is provided across the access opening (39) using a forwardly-positioned discharge outlet (5) communicating with a supply duct (45) and a forwardly-positioned return inlet (7) in communication with a return duct (41) receiving air from the air curtain (9). The air curtain (9) is substantially unsupported by any supplementary cooling airflow supplied into the product display space (3) separately from the air curtain (9).

23 Claims, 20 Drawing Sheets

(56) References Cited

U.S. PATENT DOCUMENTS

| | | | | |
|---|---|---|---|---|
| 2006/0059934 | A1 | 3/2006 | Howington et al. | |
| 2006/0199496 | A1 * | 9/2006 | Grassmuck et al. | 454/173 |
| 2010/0024446 | A1 | 2/2010 | Rohrer et al. | |

FOREIGN PATENT DOCUMENTS

| | | | |
|---|---|---|---|
| JP | H08334283 | A | 12/1996 |
| JP | 2006046885 | A | 2/2006 |
| WO | 02/05689 | A1 | 1/2002 |

* cited by examiner preferred criteria of air curtains and appliances

Key to criterion preference: 1=most preferred; 2=less preferred; 3=acceptable but least preferred CURTAIN HEIGHT (mm) - Measured vertically between the mean horizontal centre line faces of the Discharge Air Grille (DAG) and Return Air Grille (RAG)

| | | | | | | | | | | | | | | | | | | |
|---|---|---|---|---|---|---|---|---|---|---|---|---|---|---|---|---|---|---|
| 3 | 2 | 2 | 2 | 2 | 1 | 1 | 1 | 1 | 1 | 1 | 2 | 2 | 2 | 2 | 3 | 3 | 3 | 3 |
| 100 | 150 | 200 | 250 | 300 | 350 | 400 | 450 | 500 | 550 | 600 | 650 | 700 | 750 | 800 | 850 | 900 | 950 | 1000 |

DAG SLOT WIDTH (mm) - Measured between the front and rear discharge air points perpendicular to the slot length.

| | | | | | | | | | | | | | | | | | | | |
|---|---|---|---|---|---|---|---|---|---|---|---|---|---|---|---|---|---|---|---|
| 3 | 2 | 2 | 2 | 1 | 1 | 1 | 1 | 1 | 1 | 2 | 2 | 2 | 2 | 2 | 3 | 3 | 3 | 3 | 3 |
| 10 | 20 | 30 | 40 | 50 | 60 | 70 | 80 | 90 | 100 | 110 | 120 | 130 | 140 | 150 | 160 | 170 | 180 | 190 | 200 |

RATIO OF HEIGHT OF ACCESS OPENING TO WIDTH OF DAG SLOT

| | | | | | | | | | | | | | | | | | | | |
|---|---|---|---|---|---|---|---|---|---|---|---|---|---|---|---|---|---|---|---|
| 3 | 2 | 2 | 2 | 1 | 1 | 1 | 1 | 2 | 2 | 2 | 2 | 3 | 3 | 3 | 3 | 3 | 3 | 3 | 3 |
| 1 | 2 | 3 | 4 | 5 | 6 | 7 | 8 | 9 | 10 | 11 | 12 | 13 | 14 | 15 | 16 | 17 | 18 | 19 | 20 |

CURTAIN CORE JET VELOCITY (m/s) - Measured as the bulk mean velocity or, more approximately, along the linear centre line of the DAG 25mm from the discharge face of the grille.

| | | | | | | | | | | | | | | | | | | | |
|---|---|---|---|---|---|---|---|---|---|---|---|---|---|---|---|---|---|---|---|
| 3 | 3 | 2 | 2 | 1 | 1 | 1 | 1 | 1 | 2 | 2 | 2 | 2 | 2 | 2 | 3 | 3 | 3 | 3 | 3 |
| 0.1 | 0.2 | 0.3 | 0.4 | 0.5 | 0.6 | 0.7 | 0.8 | 0.9 | 1.0 | 1.1 | 1.2 | 1.3 | 1.4 | 1.5 | 1.6 | 1.7 | 1.8 | 1.9 | 2.0 |

STORAGE TEMPERATURE (K) - Defines the average temperature of the stored product in the cooled cabinet space behind the air curtain.

| | | | | | | | | | | | | | | | | | | | | | |
|---|---|---|---|---|---|---|---|---|---|---|---|---|---|---|---|---|---|---|---|---|---|
| 3 | 3 | 2 | 2 | 1 | 1 | 1 | 1 | 1 | 1 | 1 | 1 | 1 | 1 | 1 | 1 | 1 | 1 | 2 | 2 | 3 | 3 | 3 |
| -26 | -24 | -22 | -20 | -18 | -16 | -14 | -12 | -10 | -8 | -6 | -4 | -2 | 0 | 2 | 4 | 6 | 8 | 10 | 12 | 14 | 16 | 18 |

AMBIENT TEMPERATURE (K) - Defines the average ambient air temperature in a space 1.5m around the cabinet.

| | | | | | | | | | | | | | | | | | | | | |
|---|---|---|---|---|---|---|---|---|---|---|---|---|---|---|---|---|---|---|---|---|
| 3 | 3 | 3 | 2 | 2 | 2 | 2 | 1 | 1 | 1 | 1 | 1 | 1 | 2 | 2 | 2 | 2 | 3 | 3 | 3 | 3 |
| 4 | 6 | 8 | 10 | 12 | 14 | 16 | 18 | 20 | 22 | 24 | 26 | 28 | 30 | 32 | 34 | 36 | 38 | 40 | 42 | 44 |

FIG. 53

REFRIGERATED DISPLAY APPLIANCES

This invention relates to refrigerated display appliances, exemplified in this specification by refrigerated multi-deck display cases or cabinets as used in retail premises for cold storage, display and retailing of chilled or frozen food and drink products.

The invention is not limited to retail food and drink cabinets. For example, the principles of the invention could be used to display other items that require cold storage, such as medicines or scientific items that may be prone to degradation. However, the principles of the invention are particularly advantageous for retail use.

Open-fronted multi-deck display cabinets provide unhindered access to cold-stored items so that the items on display may be easily viewed, accessed and removed for closer inspection and purchase. Typically, such cabinets are cooled by a large downwardly-projected refrigerated air curtain extending from top to bottom between discharge and return air terminals over the access opening defined by the open front face of the cabinet. Additional cooling air is also supplied via a perforated back panel behind the product display space of the cabinet that bleeds air from ducts supplying the air curtain to provide more cooling at each level within that space and to support the air curtain. The levels within the cabinet are defined by shelves, which may for example comprise solid or perforated panels or open baskets.

The purposes of the air curtain are twofold: to seal the access opening in an effort to prevent cold air spilling out from the product display space behind; and to remove heat from the product display space that is gained radiantly through the access opening and via infiltration of ambient air into the product display space.

Shoppers are familiar with 'cold aisle syndrome', which describes the chill felt when walking along an aisle or row of refrigerated display cabinets in retail premises. Cold aisle syndrome is caused by cold air spilling into the aisle from the open fronts of the cabinets. The discomfort experienced by shoppers discourages them from browsing cold-stored items, which of course is contrary to good retailing practice. Also, the resulting waste of energy (both in the keeping the display cabinets cold and keeping the retail premises warm) is increasingly untenable due to rising energy costs and more stringent sustainability regulations, such as retailers' carbon-reduction commitments.

Manufacturers of retail displays have tried for many years to make refrigerated display cabinets more efficient, but with little success because the cooling design is fundamentally flawed. The air curtain over the front of the cabinet is not capable of providing an effective seal to contain the cold air inside the casing due to the 'stack effect' and other dynamic forces.

The stack effect arises from pressure forces acting on the curtain due to the effect of temperature on the buoyancy of air. Denser, cooler air sinks within the cabinet and so increases pressure within the lower part of the cabinet, pushing the air curtain outwardly away from the cabinet as the curtain descends. Conversely, there is a corresponding decrease in pressure within the upper part of the cabinet, which pulls the air curtain inwardly toward the cabinet at its upper end region and leads to entrainment and infiltration of warm, moist ambient air. The system as a whole is therefore prone to spillage of cold air and infiltration of warm air. A conventional air curtain requires high velocity to remain stable enough to seal the access opening of the cabinet. Unfortunately, however, high velocity increases the rate of entrainment of ambient air. Also, a high-velocity stream of cold air is unpleasant for a shopper to reach through to access the product display space behind the air curtain.

Entrainment of ambient air into the air curtain drives infiltration of the ambient air into the product display space and contributes to spillage of cold air from the appliance. Entrainment is also unwelcome for other reasons. The heat of the ambient air increases cooling duty and hence the energy consumption of the appliance. The moisture that it carries is also undesirable because it causes condensation, which may also lead to icing. Condensation is unsightly, offputting and unpleasant for shoppers, may threaten reliable operation of the appliance and promotes microbial activity which, like all life, requires the presence of water. Also, the incoming ambient air will itself contain microbes, dust and other undesirable contaminants.

As noted previously, cold air supplied to the product display space through the back panel of the cabinet not only provides cooling to each shelf but also provides support to the air curtain. This back panel flow may therefore be used to reduce the required air curtain velocity and so to reduce the entrainment rate of ambient air. However, back panel flow has the disadvantage that the coldest air blows over the coldest items at the back of the shelves, which are subject to the lowest heat gain because they are furthest from the access opening. This undesirably increases the spread of temperature across items stored in the product display space: ideally, similar items should all be stored at the same temperature.

Refrigeration preserves foods by lowering their temperature to retard microbial activity. If the storage temperature is not kept low enough, microbial activity will degrade items too quickly. However, excessive refrigeration—and especially inadvertent periodic freezing—may also degrade the quality of some items. It is therefore vital that tight temperature control is maintained throughout the product display space of the cabinet. Regions of a cabinet warmer than the desired temperature will suffer from faster food degradation. Conversely, regions of a cabinet colder than the desired temperature may cycle above and below the freezing point, again promoting faster food degradation.

Back panel flow is an example of supporting flow, being a flow of cooling air that is not delivered through the discharge air terminal as part of the air curtain. It typically accounts for 20% to 30% of the total air flow within a conventional cabinet, with the remaining 70% to 80% being circulated as the air curtain itself. Back panel flow offers essential support to the air curtain in a conventional refrigerated display cabinet which, at typical discharge velocities, would otherwise be incapable of sealing an access opening with dimensions typical of such a cabinet without support. The back panel flow is also necessary to provide supplementary cooling to the stored product because the temperature rise of the main air curtain over the length of the air curtain is too great to meet the cooling demand unaided.

Even with measures such as back panel flow, conventional cabinets can suffer from ambient entrainment rates as high as 80% in real conditions, causing excessive energy consumption and uncomfortably cold aisles. The emphasis here is on 'real conditions', because the standards and protocols under which refrigerated cabinets are typically performance-tested tend to distort perceptions of their energy efficiency. Whilst performance-testing standards are stringent, they allow appliances to be taken from the production line and optimised carefully over a long period to produce the best test results.

Optimisation involves incremental changes to the locations of test packs representing items of stored food within the product display space, and fine adjustments of defrost schedules and evaporating temperatures to balance cooling airflows around the cabinet. Airflow optimisation changes the distribution of air between the air curtain and air supplied at each level via the perforated back panel. Consequently, the tested cabinet is optimised for only one precise product loading configuration. That particular configuration can be difficult to replicate, even in a laboratory.

In real conditions, refrigerated display cabinets are loaded in many different ways with a huge variety of differently-shaped and differently-sized items. None of these actual loading patterns will match the idealised loading pattern used for energy performance testing; indeed, most will be very different. Consequently, the energy consumption of a cabinet in real conditions bears little resemblance to the published performance figures for that cabinet. There is a need for a cabinet design whose performance is less dependent upon variations in loading patterns in real conditions.

In summary, current open-fronted multi-deck refrigerated display cabinets compromise the physiological requirements for optimal food storage. The air curtain fails to seal the cabinet effectively, causing poor temperature control and high infiltration rates. Warm moist ambient air enters the cabinet, warming items stored within and depositing moisture as condensation upon them. Warmer temperatures and higher moisture levels promote microbial activity, which reduces shelf-life, causes off-odours, promotes fungal growth and can cause food poisoning.

Consequently, it has become popular to fit sliding or hinged glass doors to the front of a refrigerated display cabinet. Initially this may appear to solve the problems suffered by open-fronted cabinets because the cold air is held behind the doors, saving energy and preventing cold aisle syndrome. However, the use of doors has many disadvantages:

- Doors put a barrier between the shopper and the displayed items, which merchandisers know can reduce sales significantly in relation to open-fronted cabinets —by as much as 50%, some studies suggest.
- Doors create a barrier, and additional work, for staff tasked with restocking, cleaning and maintaining the cabinets. In this respect, the doors need to be kept spotlessly clean on the inside and outside to maintain a hygienic and attractive appearance. The doors are also susceptible to damage and hence may need occasional replacement. All of this adds significantly to retail overheads. It also has a bearing upon health-and-safety considerations and risk-mitigation actions required by retailers.
- In a fast-turnover retail environment, shoppers will open the doors frequently to access the stored products. Restocking, cleaning and maintenance by staff will also involve opening the doors, less frequently but for much longer periods. Whenever the doors are open, cold dense air will spill out. The cold air lost from inside the cabinet will inevitably be replaced by warm moist ambient air.
- As a result of the cold air spillages arising from door openings during purchasing, restocking, cleaning and maintenance, temperature control and moisture ingress in real conditions is not significantly better than in conventional open-fronted cabinets. So, regions of the storage space within the cabinet will suffer from poor temperature control and higher moisture levels, accelerating degradation of stored items. This also means that energy consumption is not significantly better than in conventional open-fronted cabinets. Additionally, under some conditions, heat may need to be applied to the doors to reduce fogging and misting following door opening; this can actually lead to an overall increase in energy consumption over conventional open-fronted cabinets.
- As with conventional open-fronted cabinets, testing of energy consumption is carried out in unrealistic conditions following extensive optimisation and so the published figures are misleading. Energy consumption in real conditions is likely to be significantly higher than the published figures.
- Store layouts may need to be changed to allow for the addition of doors to refrigerated display cabinets. In particular, wider aisles may be required in retail premises due to the ergonomics associated with general access and with shoppers opening doors and managing trolleys. Wider aisles reduce the sales return per square meter of retail space.

Shoppers like open-fronted multi-deck refrigerated display cabinets because they afford easy product visibility and access. Retailers like such cabinets because they allow a wide range of products to be displayed clearly to and accessed easily by shoppers, with reduced maintenance overheads and better utilisation of retail floor space. The present invention therefore aims to provide open-fronted refrigerated display cabinets that significantly reduce entrainment, provide tight temperature control, reduce cold aisle syndrome and save energy —without needing doors or other barriers to do so.

Against this background, the present invention resides in refrigerated display unit, comprising: an open-fronted cabinet containing a product display space accessible through an access opening defined by the open front; a cooling means for introducing or producing cold air to refrigerate items in the product display space in use; at least one forwardly-positioned discharge outlet communicating with a supply duct for, in use, projecting cold air as an air curtain across the access opening; and at least one forwardly-positioned return inlet communicating with a return duct for, in use, receiving air from the air curtain; wherein the air curtain is substantially unsupported by any supplementary cooling airflow supplied into the product display space separately from the air curtain.

Further, the invention resides in: a refrigerated display unit comprising: an open-fronted cabinet defining a cold-storage volume; a cooling means for introducing or producing cold air to refrigerate items in the cold-storage volume in use; and a plurality of shelves disposed in the cold-storage volume for supporting refrigerated items in use, the shelves being arranged in side-by-side columns; wherein each shelf defines an upper access opening above the shelf and a lower access opening below the shelf affording access to refrigerated items in respective product display spaces in the cold-storage volume above and below the shelf, and each shelf has: at least one forwardly-positioned discharge outlet communicating with a supply duct for, in use, projecting cold air as an air curtain across the lower access opening; and at least one forwardly-positioned return inlet communicating with a return duct for, in use, receiving air from another air curtain discharged above the shelf across the upper access opening.

The invention also resides in: a refrigerated display unit, comprising: an open-fronted cabinet defining a product display space bounded by at least one upright wall; a cooling means for introducing or producing cold air to refrigerate items in the product display space in use; at least one shelf for, in use, supporting refrigerated items to be displayed for viewing and access, the shelf being selectively locatable at different positions on the upright wall; wherein the or each shelf has airflow supply and return channels connectable to supply and return ducts through ports spaced on the upright wall; and at least one upright partition divides the cold-storage volume into two or more columns within which shelves can be moved vertically between selected positions.

Optional features of the invention are set out in the claims and in the description.

On one level, the invention lies in the realisation that it is advantageous to reduce the height of an air curtain, and in various reduced-height air curtain configurations that have those advantages. On another level, the invention provides advantageous technical solutions that enable the height of an air curtain to be reduced.

Reducing the height of an air curtain reduces the stack effect and so reduces horizontal force on the curtain for the same temperature difference across the curtain. For a given initial discharge direction, a significantly lower discharge momentum will suffice. So, a significantly lower discharge velocity can be used, leading to reduced entrainment of ambient air and lower energy consumption.

Reducing the height of an air curtain therefore enables a lower initial velocity to be used and reduced deflection of the curtain to be achieved. This improves control and consistency of the air curtain in addition to improving its energy efficiency and cooling efficacy in real-world conditions—and not merely in highly-artificial laboratory testing.

In order that the invention may be more readily understood, reference will now be made by way of example to the accompanying drawings and table, in which.

Figure 1:
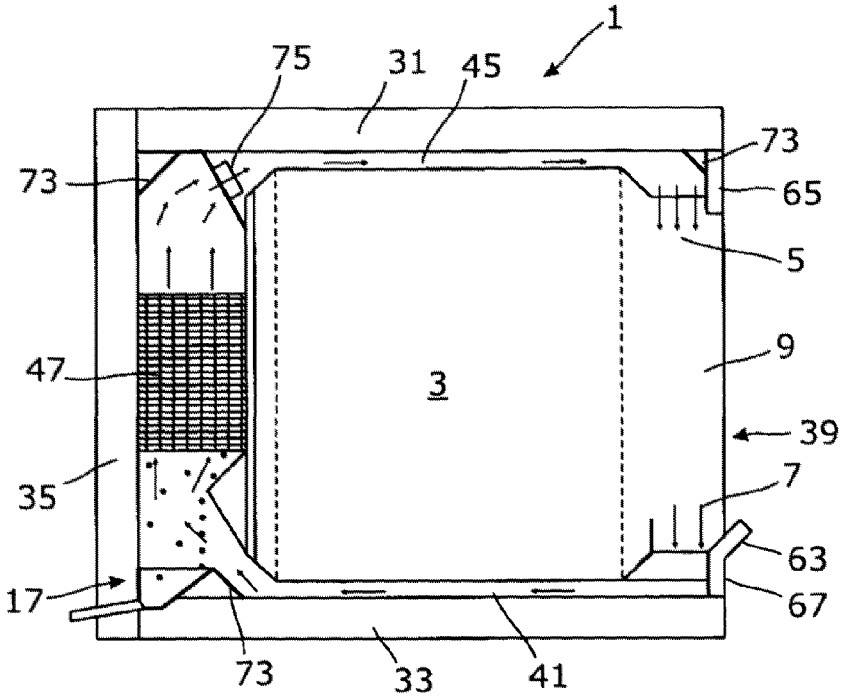
FIG. 1 is a sectional side view of an appliance of the invention in a first, simple embodiment of the invention.
Figure 16:
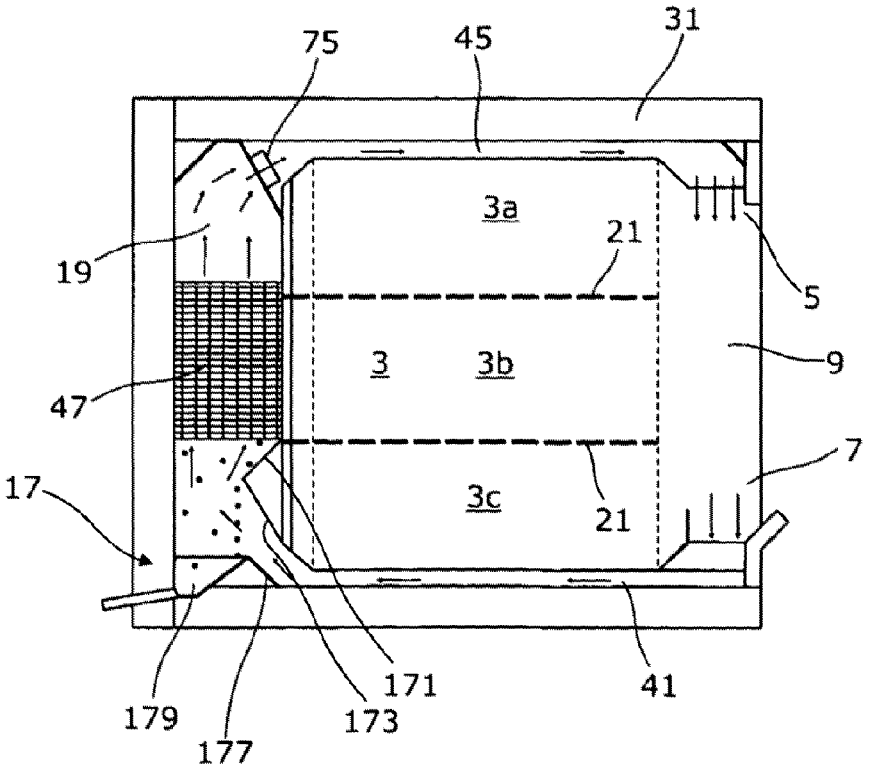
Figure 17:
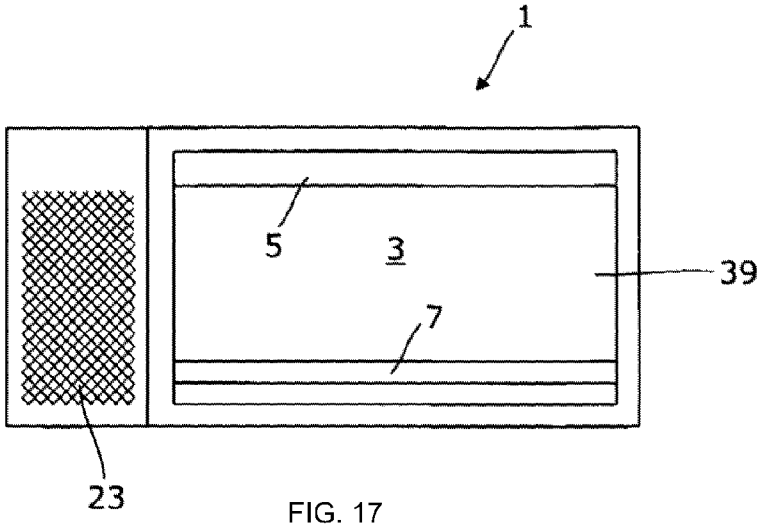
Figure 18:
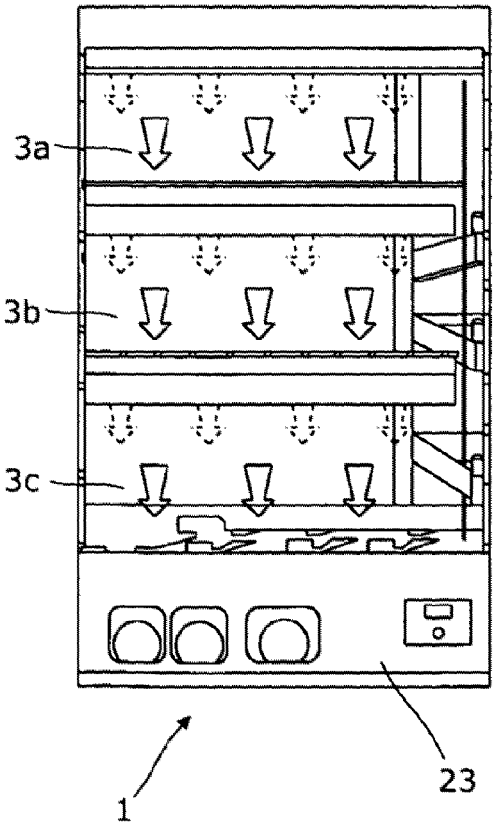
Figure 19:
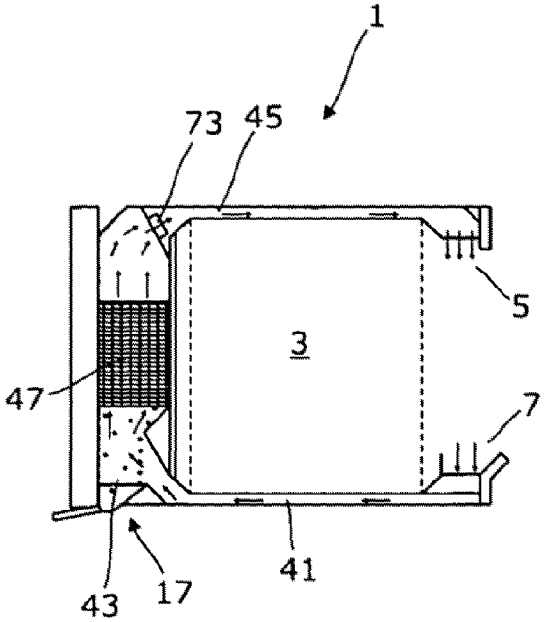
Figure 20:
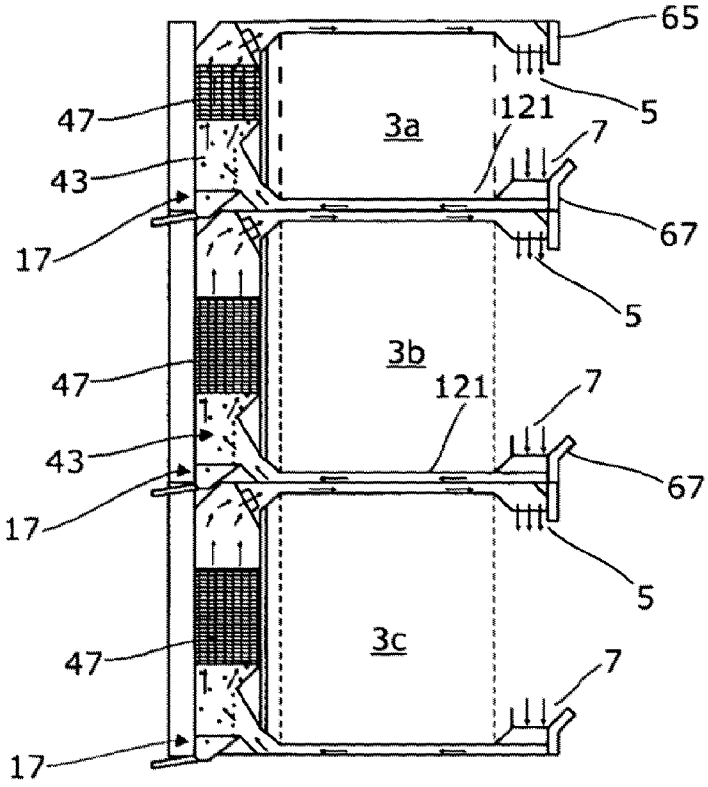
Figure 21:
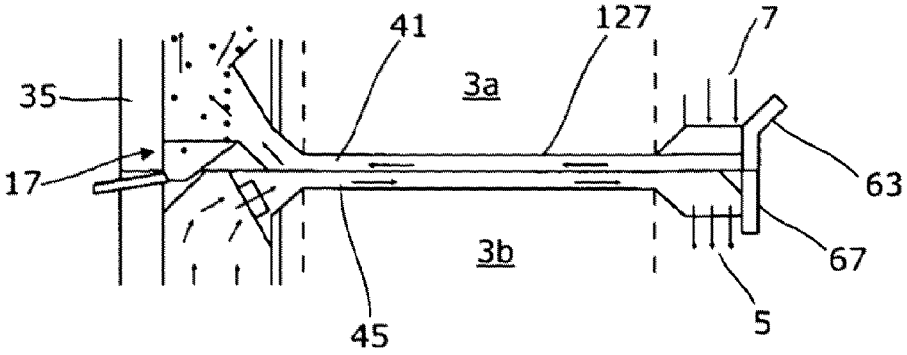
Figure 22:
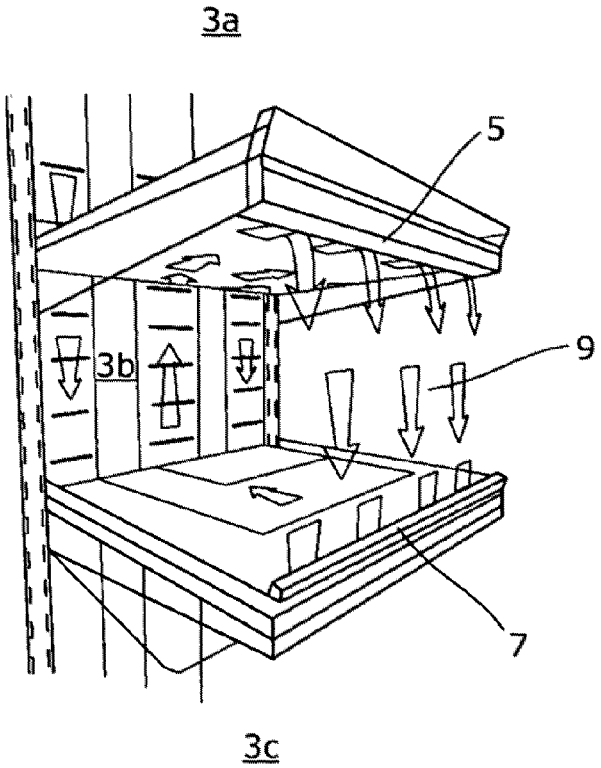
Figure 23:
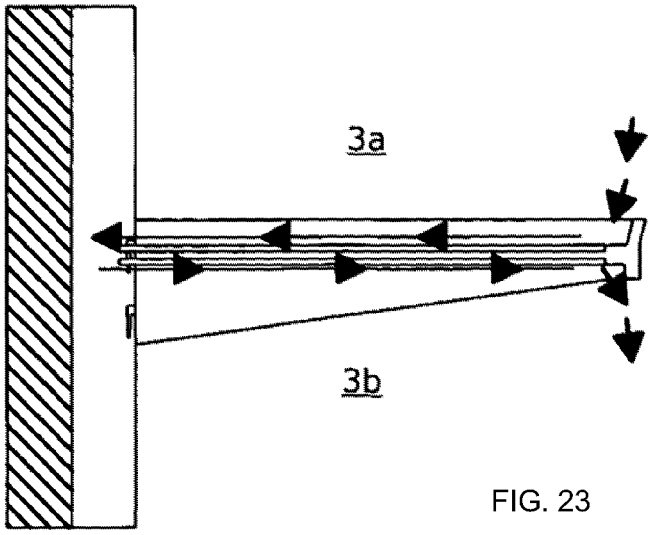
Figure 24:
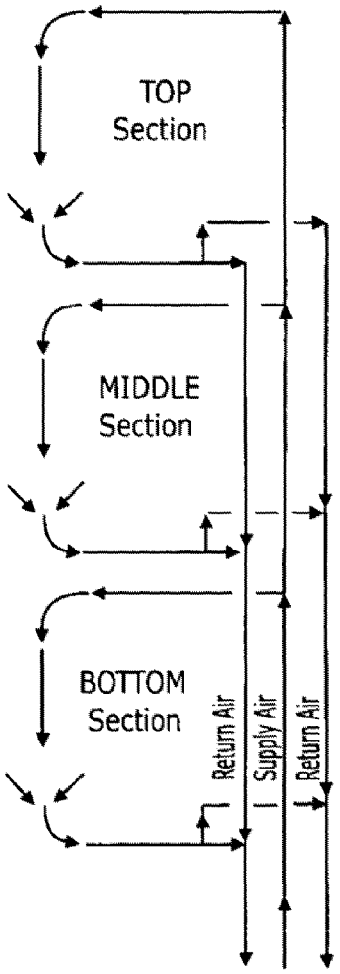
Figure 25:
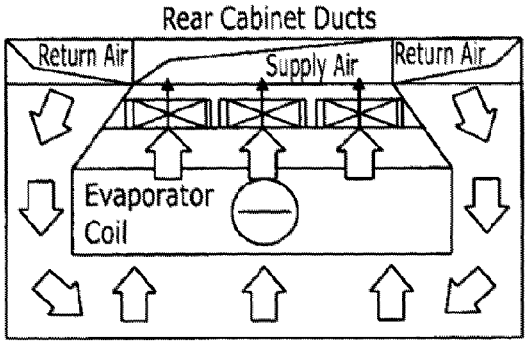
Figure 26:
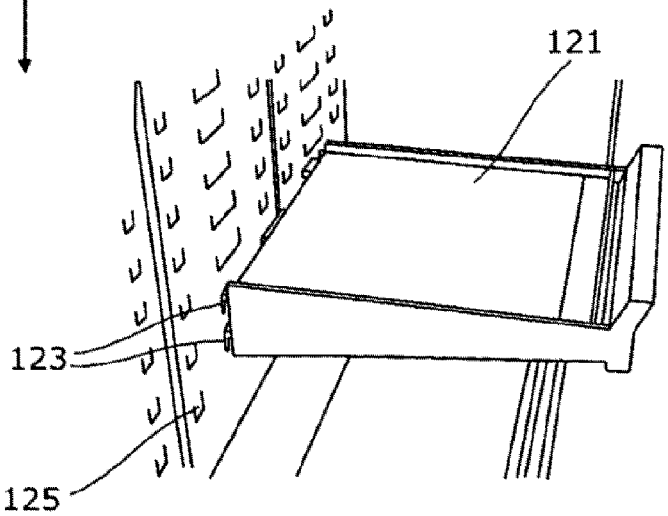
Figure 27:
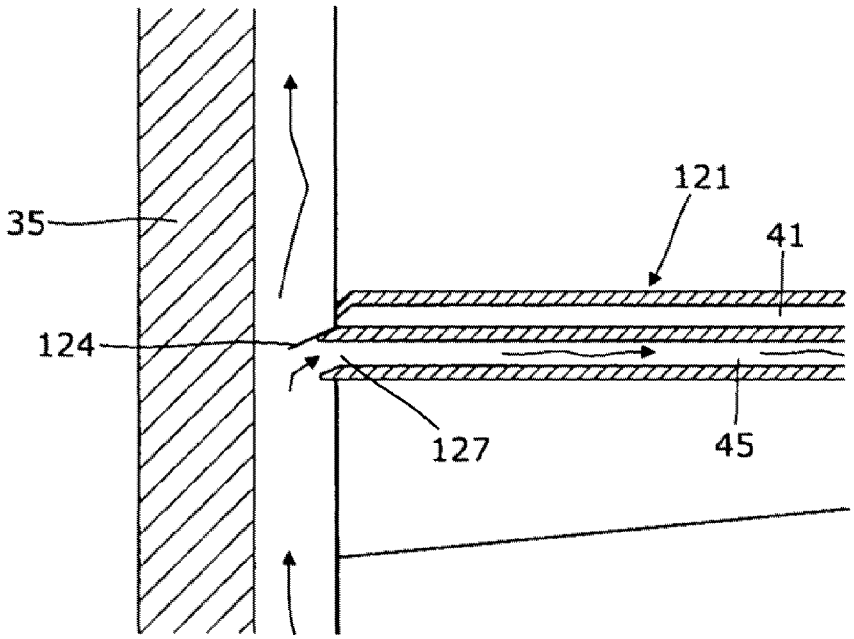
Figure 28:
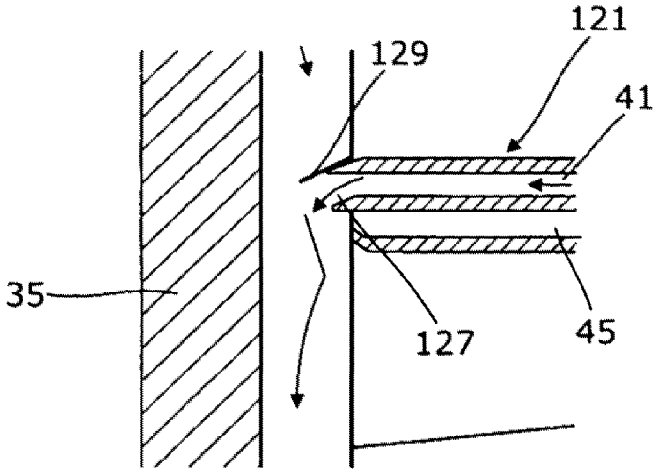
Figure 29:
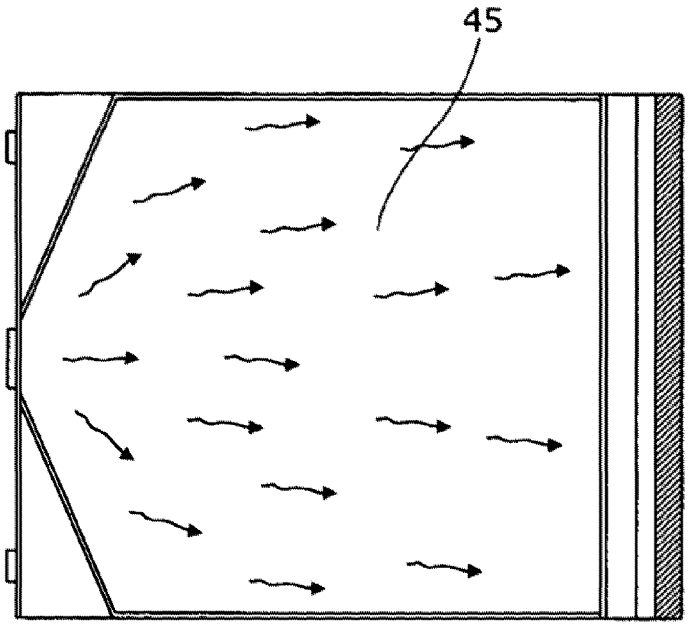
Figure 30:
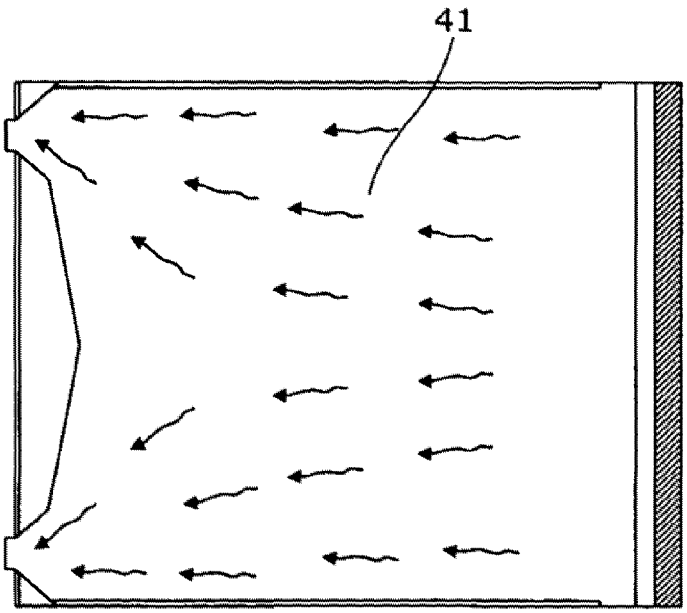
Figure 31:
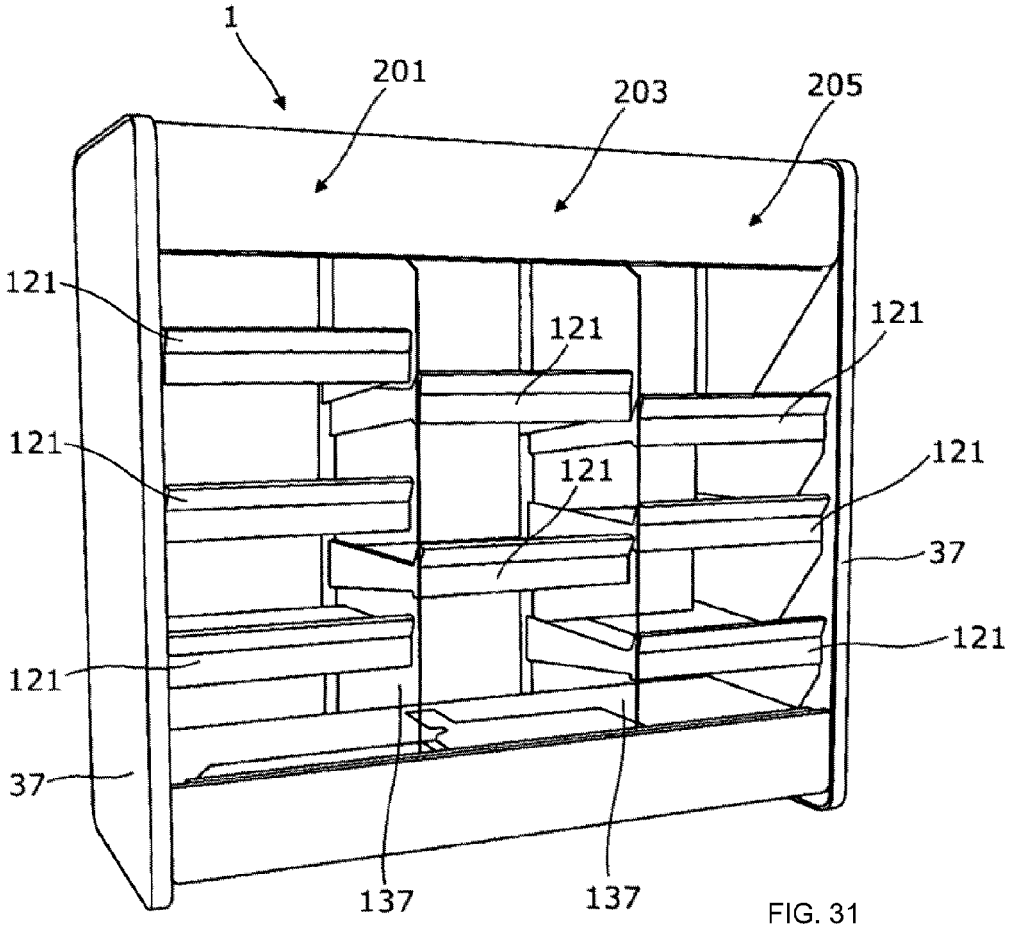
Figure 32:
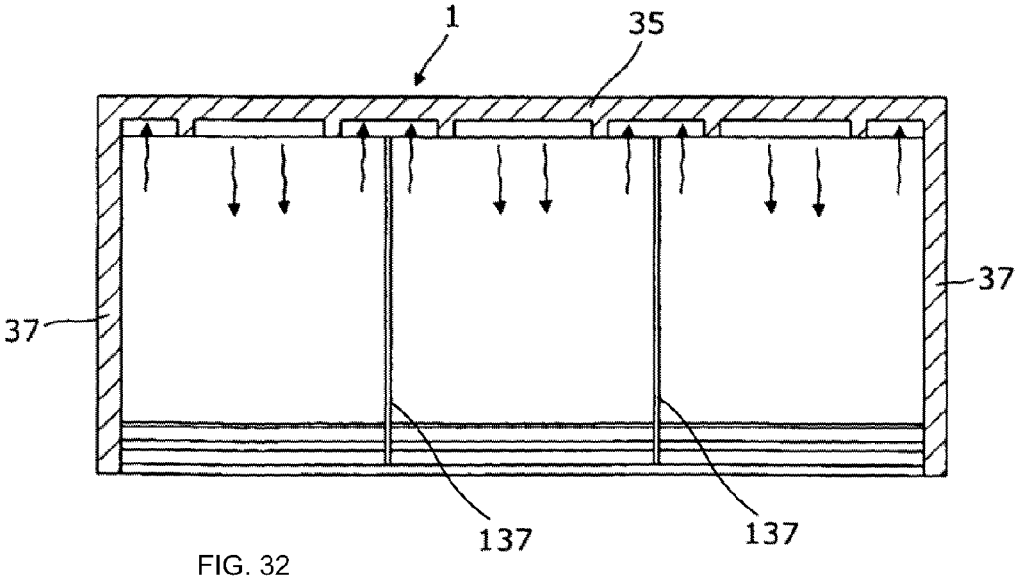
Figure 33:
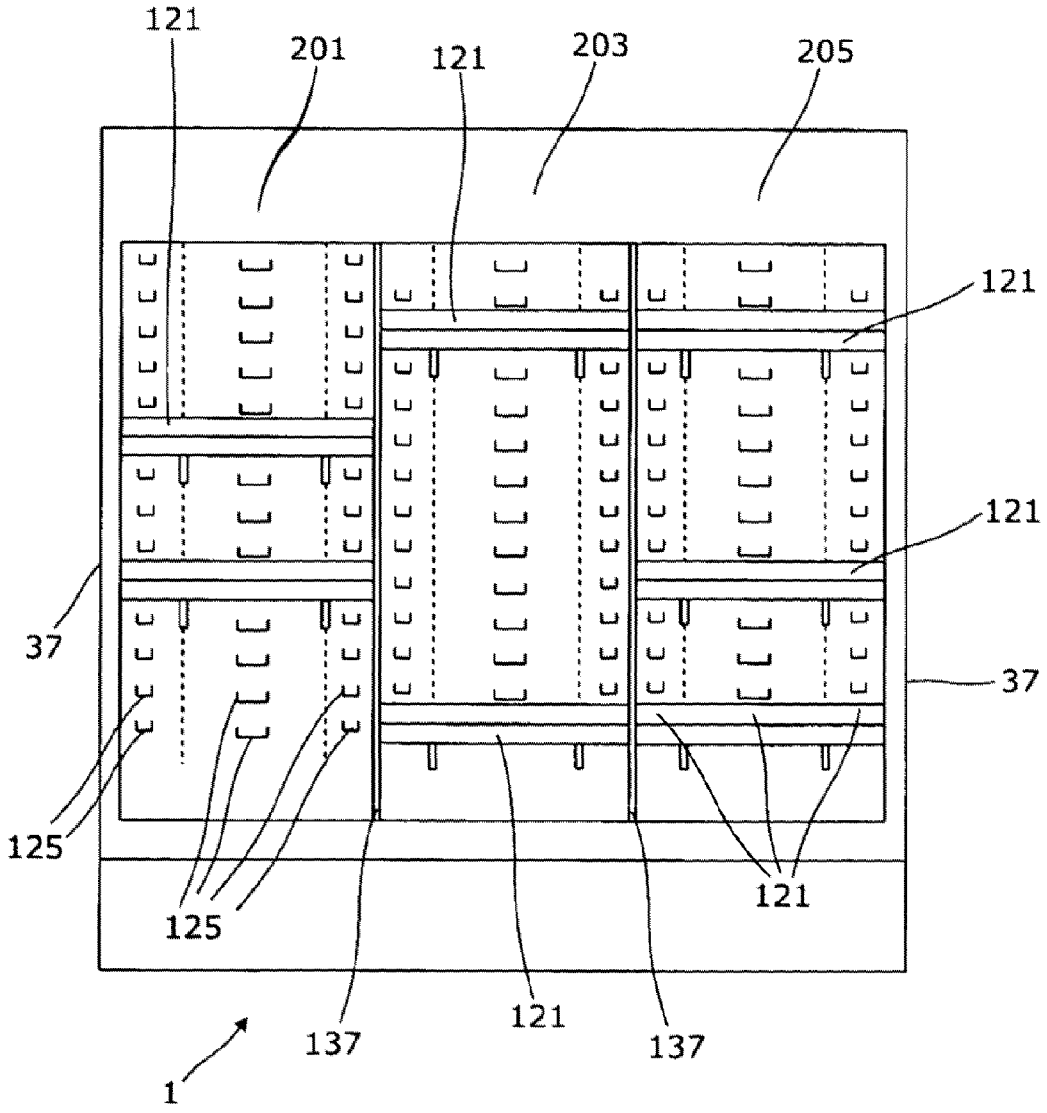
Figure 34:
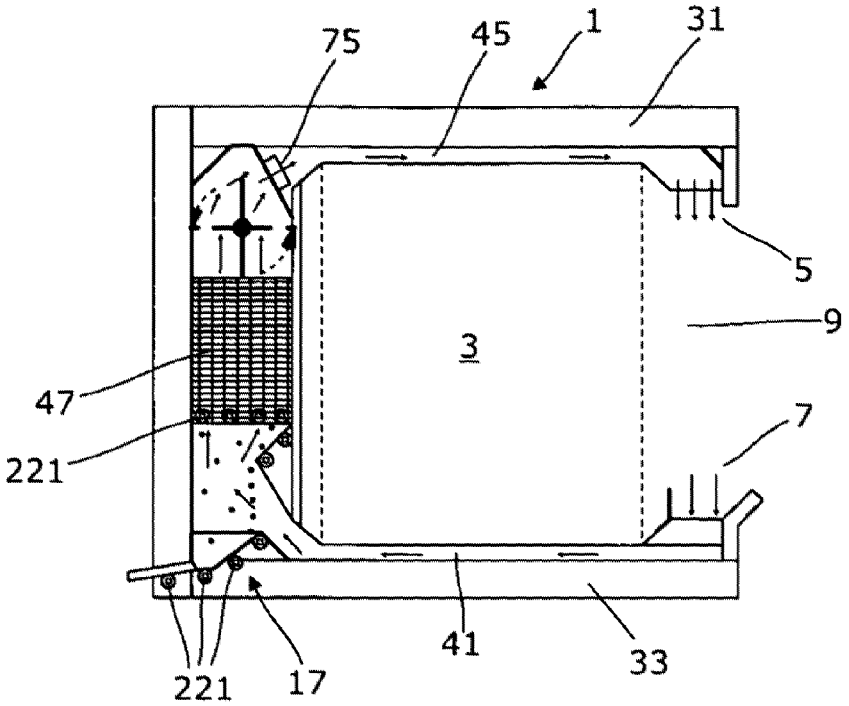
Figure 35:
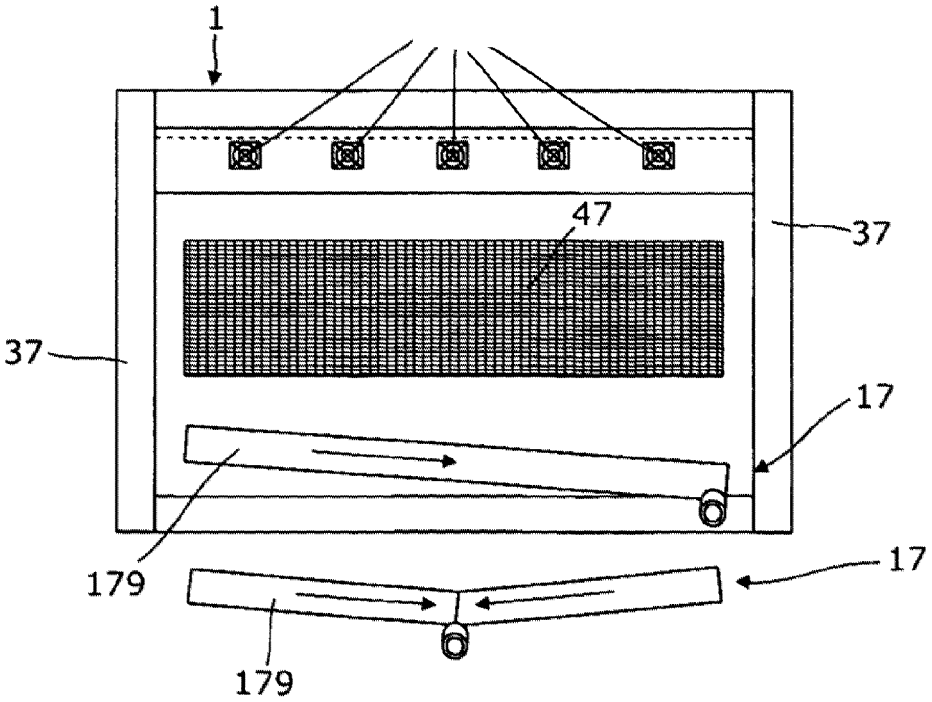
Figure 36:
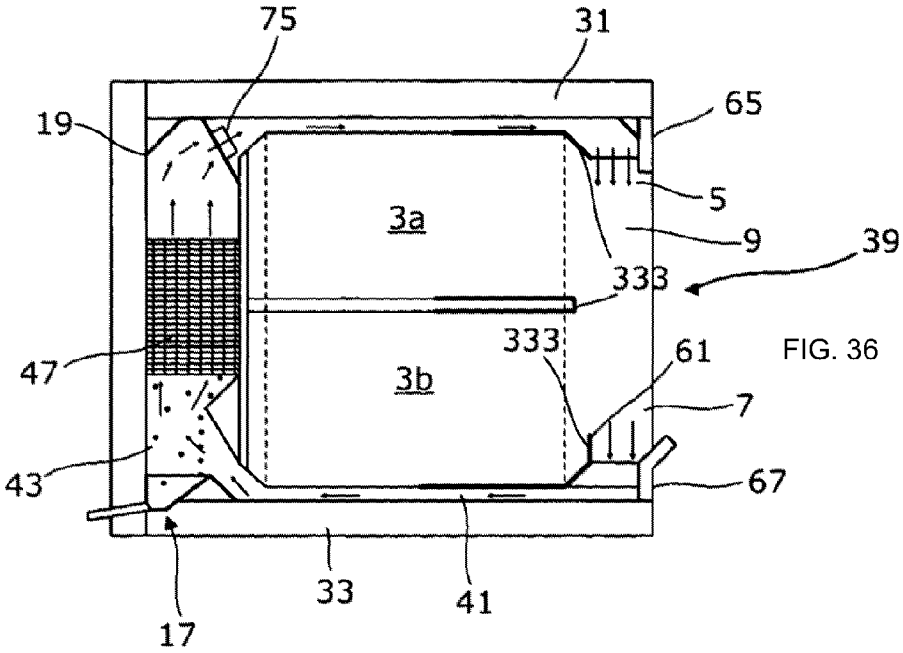
Figure 37:
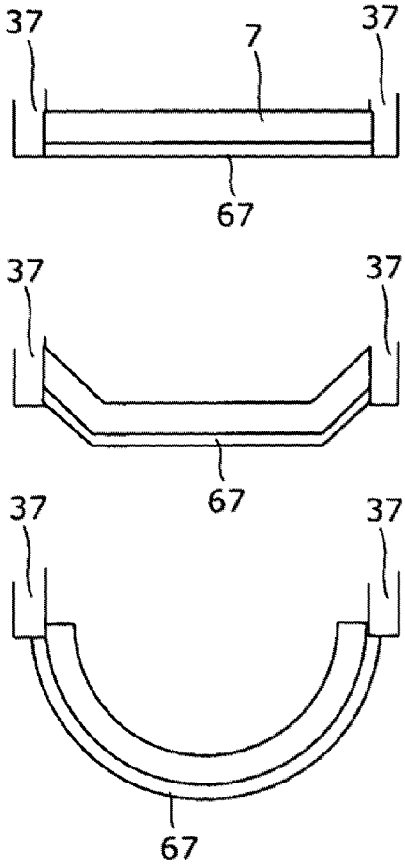
Figure 38:
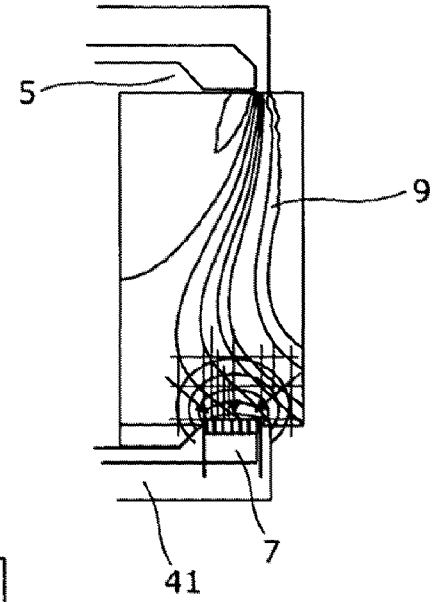
Figure 39:
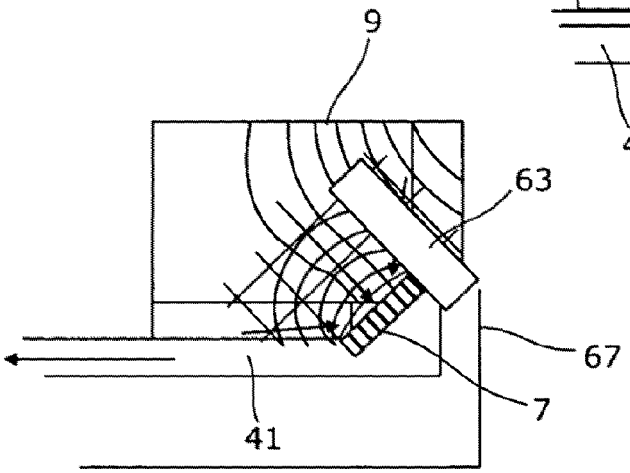
Figure 40:
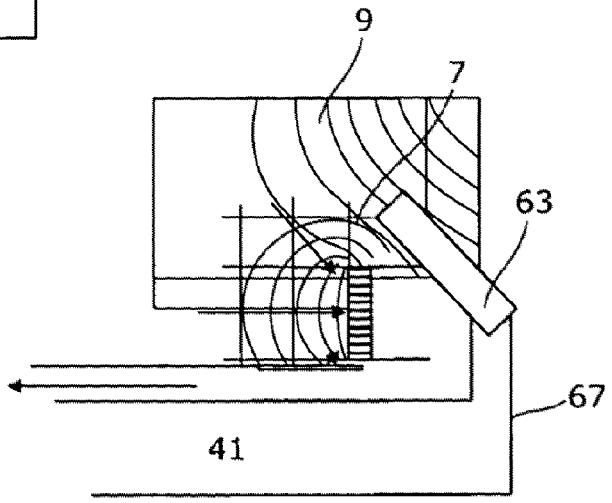
Figure 41:
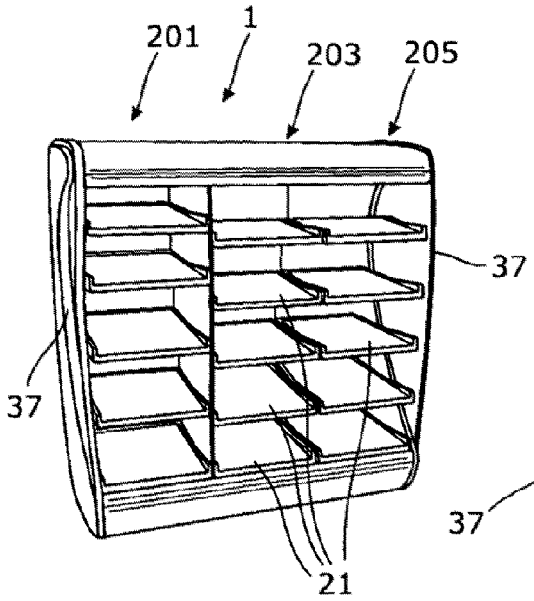
Figure 42:
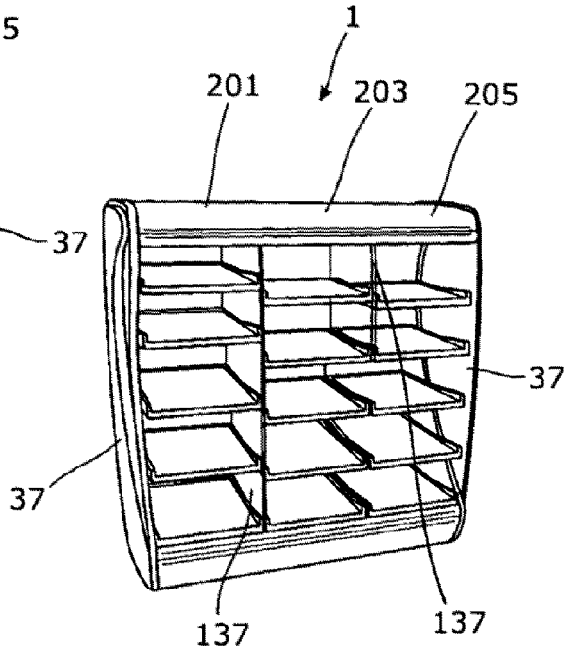
Figure 43:
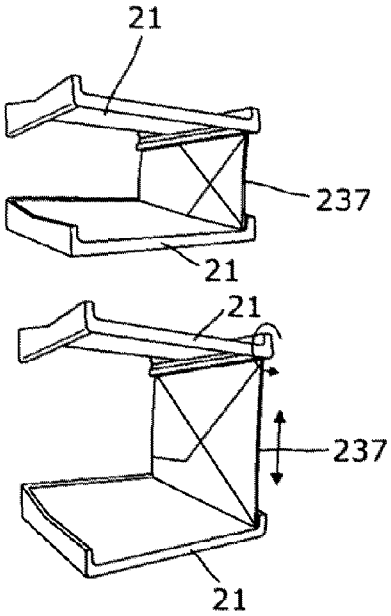
Figure 44:
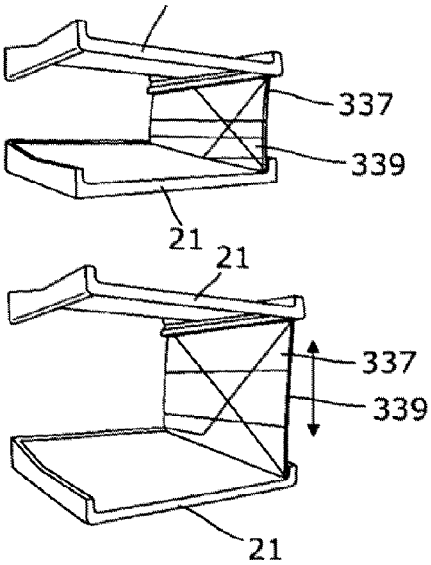
Figure 45:
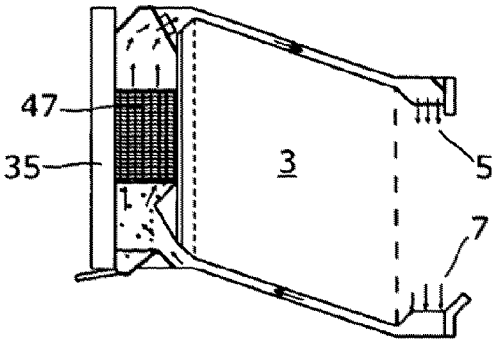
Figure 46:
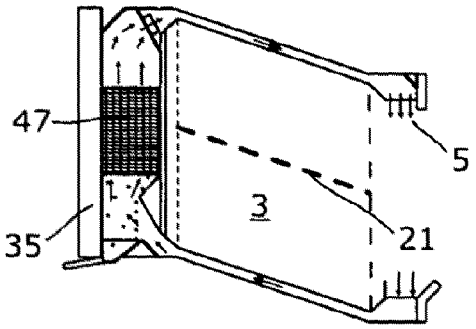
Figure 47:
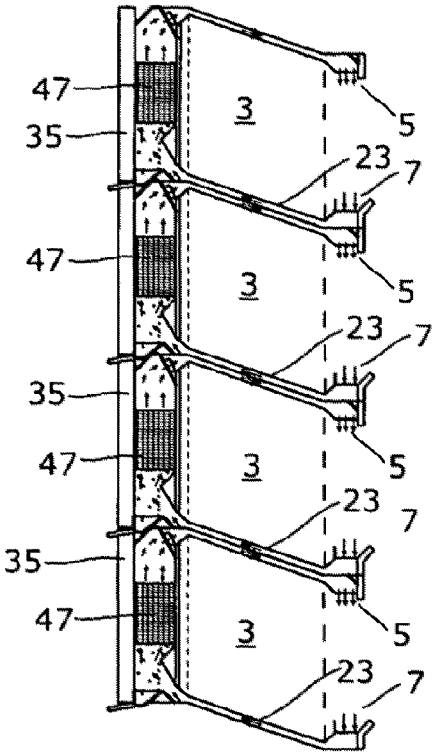
Figure 48:
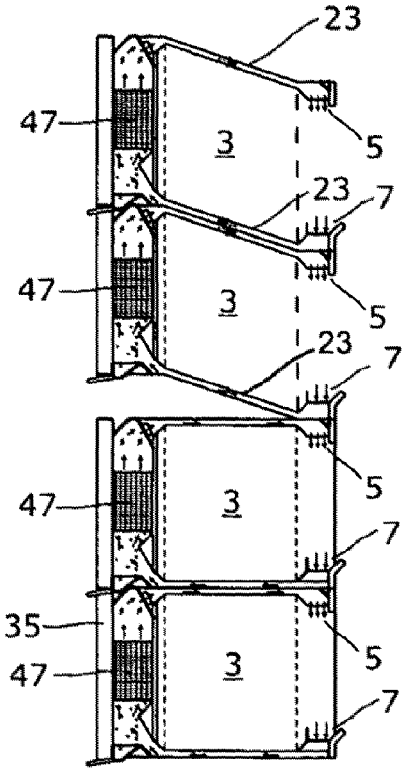
Figure 49:
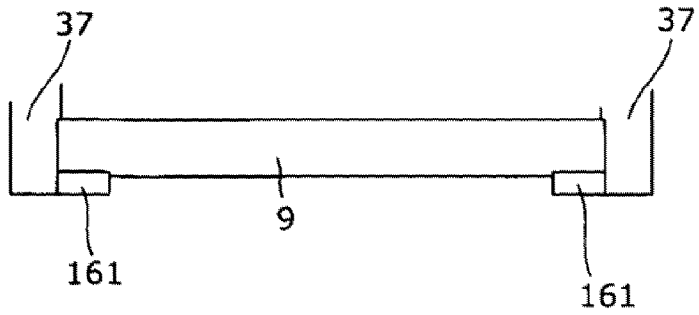
Figure 50:
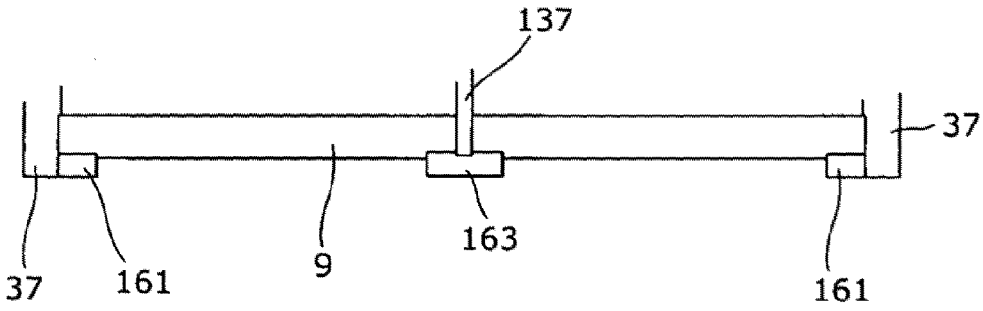
Figure 51:
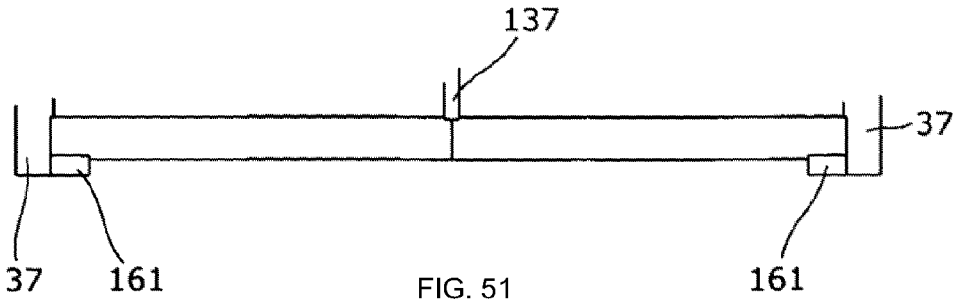
Figure 52:
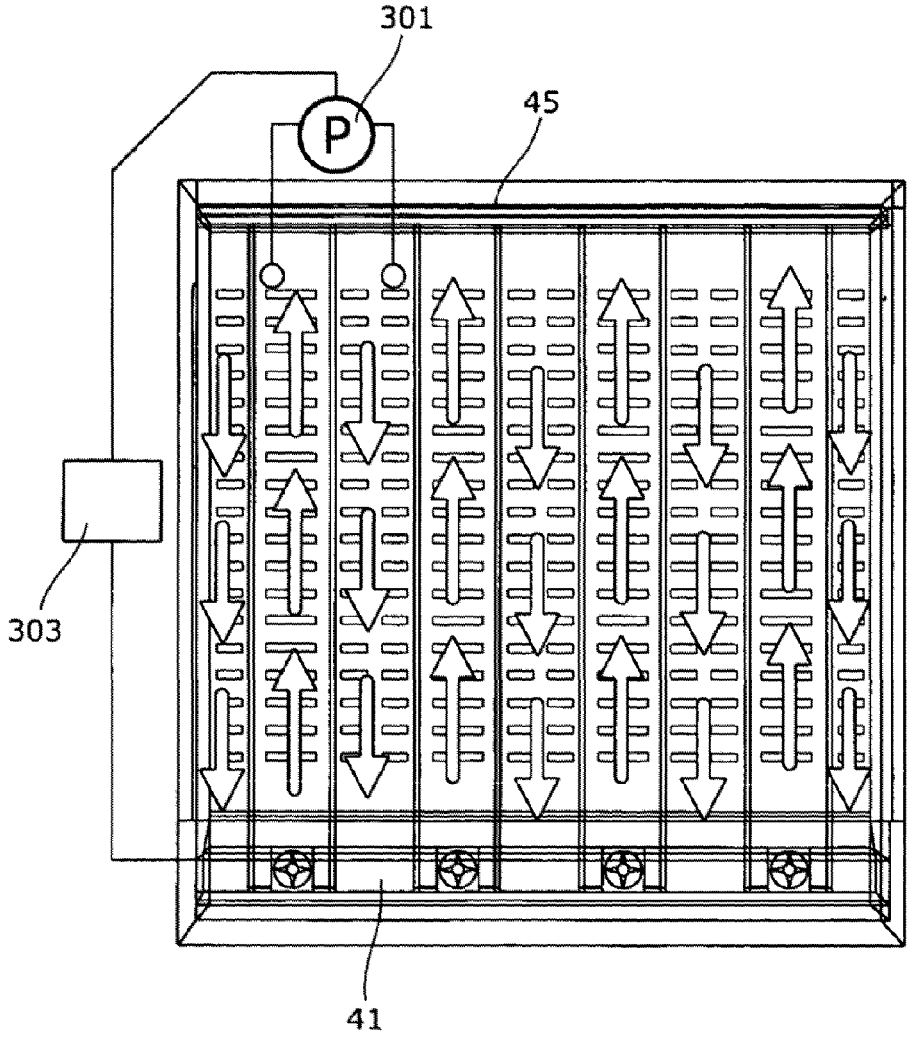

FIG. 16 corresponds to FIG. 1 but shows a variant of the first embodiment with intermediate shelves within the cold-storage space of the appliance;

FIG. 17 is a front view of the appliance of the invention, having an optionally side-mounted refrigerator engine;

FIG. 18 is a front view of an appliance being a second embodiment of the invention, having a bottom-mounted cooling engine and a plurality of airflow-managed cells sharing a single insulated cabinet and that cooling engine;

FIG. 19 is a sectional side view of an airflow-managed cell of the appliance shown in FIG. 18;

FIG. 20 is a sectional side view of the appliance of FIG. 18, showing how airflow-managed cells are stacked to create the appliance;

FIG. 21 is an enlarged detail view of a shelf of the appliance of FIG. 20;

FIG. 22 is a perspective detail view showing a variant of the appliance of FIG. 20, with shared cooling airflow derived from a common cooling means;

FIG. 23 is a sectional detail side view of a shelf of the variant shown in FIG. 22;

FIG. 24 is an airflow distribution diagram showing the operation of supply and return ducts in the appliance of FIG. 22;

FIG. 25 is a schematic plan view of airflow in the appliance of FIG. 22 between supply and return ducts and the common cooling means;

FIG. 26 is a perspective detail view showing a solution that enables the height of ducted shelves to be adjusted;

FIGS. 27 and 28 are enlarged detail side sectional views showing cooperation between spigots and ports in the solution shown in FIG. 26, in supply ducts and return ducts respectively;

FIGS. 29 and 30 are sectional top views of a shelf on two levels, showing supply ducts and return ducts respectively of the shelf shown in FIG. 26;

FIG. 31 is a front perspective view of a third embodiment of the invention in which airflow-managed cells are disposed in side-by-side columns in a refrigerated display appliance;

FIG. 32 is a sectional top view of the appliance of FIG. 31, showing supply and return airflow ducts behind its back inner panel;

FIG. 33 is a front view of the appliance of FIG. 31, showing the layout of arrayed mounting points and ports in the back inner panel of the appliance;

FIG. 34 is a side view of a variant of the appliance shown in FIG. 1, with alternative drainage and defrosting arrangements;

FIG. 35 is a rear view of the appliance of FIG. 34;

FIG. 36 is a side view of a further variant of the appliance shown in FIG. 1, with additional radiant cooling surfaces;

FIG. 37 is a series of schematic plan views that illustrate and contrast various possible frontal shapes of a refrigerated display appliance, showing their effect on the shape of the air curtain and the finishers that guide the air curtain;

FIG. 38 is a schematic diagram that shows the dynamic and thermal forces affecting the air curtain, with differently-shaded bands representing isotherms in the air curtain, and also shows a typical velocity profile around the return air grille;

FIGS. 39 and 40 are enlarged detail views that correspond to FIG. 38 but show alternative arrangements of the return air grille and airflow-guiding structures around that grille;

FIG. 41 is a front perspective view of a multi-cell, plural column appliance like that of FIG. 31, showing how a partition between neighbouring columns may be removed if the shelves of those columns are aligned;

FIG. 42 is a front perspective view the appliance of FIG. 41, showing how a mini-partition may be created between neighbouring columns if some shelves of those columns are aligned and other shelves of those columns are not aligned;

FIGS. 43 and 44 are front perspective detail views showing possible alternative arrangements for mini-partitions supported by shelves of neighbouring columns;

FIGS. 45 and 46 are sectional side views of a fourth embodiment of the invention being an airflow-managed cell having sloping shelves, with FIG. 42 additionally showing an intermediate shelf within the chilled cavity;

FIG. 47 is a sectional side view of an appliance subdivided into airflow-managed cells with sloping shelves as shown in FIG. 41;

FIG. 48 is a sectional side view of a variant of the appliance shown in FIG. 43 with a mix of airflow-managed cells, some with sloping shelves and others without;

FIG. 49 is a schematic plan view of the forward part of a refrigerated display appliance of the invention, showing side finishers that protect the air curtain along its side edges;

FIG. 50 corresponds to FIG. 49 but shows a similar partition finisher on the front edge of a partition that divides airflow-managed cells into columns;

FIG. 51 corresponds to FIG. 50 but shows an alternative approach that positions the front edge of the partition behind adjacent air curtains;

FIG. 52 is a front view of a refrigerated display appliance of the invention, showing a differential pressure sensor that reads and compares pressure in supply and return ducts and adjusts fan speed to balance the system; and FIG. 53 sets out some preferred criteria, and values for each criterion, for air curtains and appliances in accordance with the invention.

Referring firstly to FIG. 1 of the drawings, this shows a refrigerated display unit 1 in accordance with the invention. The unit 1 is shown here in a simple form as a discrete appliance that is capable of stand-alone operation, although a support structure such as a storage or display cabinet beneath would be required in practice to raise such a unit to a height suitable for easy access. A plurality of such units 1 may be used side-by-side, stacked in modular fashion and/or distributed around the retail area to create a larger refrigerated display. It will be explained later how the principles of a modular plurality of such units may be used to create an integrated multi-cellular display appliance.

The unit 1 shown in FIG. 1 is generally in the form of a hollow cuboid or box comprising insulated top 31, bottom 33, side 37 and back 35 walls enclosing a correspondingly-shaped product display space 3 shown here as a hatched zone. A front access opening 39 is shown to the right side of FIG. 1, defined between the top 31, bottom 33 and side 37 walls of the unit. This access opening 39 gives unhindered reach-in access to any items in the product display space 3 behind the access opening 39.

One or both of the side walls 37 could be transparent to enhance visibility of the items displayed in the product display space 3, in which case the side walls 37 are suitably of tempered glass and double- or triple-glazed to maintain a degree of insulation.

In use, the access opening 39 is sealed by a generally vertical air curtain 9 that flows downwardly in front of the product display space. The air curtain 9 extends between a downwardly-projecting discharge air grille or DAG 5 and an upwardly-receiving return air grille or RAG 7. Cooled air is supplied to the DAG 5, which projects the air curtain 9, and is returned via the RAG 7, which receives air from the air curtain 9. The air received from the air curtain 9 will inevitably include some entrained ambient air, although the present invention will greatly reduce the rate of entrainment in comparison with prior art designs.

In this locally-cooled example, the air circulates within the unit between the RAG 5 and the DAG 7 through ducts 41, 43, 45 inside the bottom 33, back 35 and top 31 walls of the unit 1. The ducts 41, 43, 45 are defined between the insulation of the respective walls and relatively thin inner panels extending parallel to and spaced inwardly from that insulation. The ducts comprise bottom 41 and back return 43 ducts in the bottom and back walls of the unit respectively, and a supply duct 45 in the top wall of the unit. Ducts and air spaces are suitably sealed to prevent air leakage to/from ambient or short circulation of air between higher- and lower-pressure spaces in the unit.

The inner panels will become cold in use due to the cold air flowing behind them, and so will provide some cooling to the product display space 3. Indeed, in this embodiment, no cooling air is supplied through any of the inner panels. The cold surfaces of the top 31, bottom 33 and back 35 inner panels are sufficient to maintain good temperature control of items within the storage space, when the air curtain 9 is correctly specified.

All or some of the inner panels may have no insulation or heating but insulation and/or local trace heating may be provided on some or all of the inner panels to control their temperature. For example, insulation or local heating may be necessary to prevent over-cooling of adjacent items in the product display space. In this respect, the back panel is shown here as being thinly-insulated to suit the region of the product display space that is furthest from the access opening 39 and hence subject to the lowest heat gain.

In principle, one or more of the inner panels could be penetrated by one or more openings such as perforations communicating with the duct behind, if it is desired to bleed some cold air from the duct to apply locally increased cooling to counter heat gain. However as heat gain will generally be highest at the open front of the unit, it is expected that the air curtain 9 will provide the cooling necessary to counter heat gain experienced in that region, without further air being supplied through the inner panels.

Cooling air may be produced remotely and ducted to and from the unit but the embodiment shown in FIG. 1 employs air that is cooled and circulated locally in the unit itself. For this purpose, a cooling coil, a drainage system and a fan array are situated in the duct inside the back wall of the unit. Local cooling and impeller means could instead be located to the top, bottom or a side of the unit. Associated local drainage provisions can be located where convenient.

Reference is now made additionally to the enlarged views of FIGS. 2 to 7, which show the DAG 5 and RAG 7 in detail.

The ducts and the DAG 5 and RAG 7 are designed to produce smooth and even airflow characteristics. In general, square bends are avoided in favour of mitered 73, 173, inclined. chamfered or rounded bends, or bends provided with turning vanes, guides and baffles.

The DAG 5 has a substantially horizontal discharge face communicating with a supply plenum above, that communicates in turn with the narrower supply duct 45 in the top wall of the unit behind the supply plenum. The discharge face of the DAG 5 is on a level below the supply duct 45 and is joined to the supply duct 45 by an inclined or chamfered corner. In this example, a correspondingly-inclined corner fillet is opposed to the chamfered corner across the supply plenum.

The RAG 7 has a substantially horizontal intake face communicating with a return plenum below, that communicates in turn with the narrower return duct 41 in the bottom wall of the unit behind the return plenum. The intake face of the RAG 7 is on a level above the return duct 41 and is joined to the return duct 41 by an inclined or chamfered corner like that of the DAG 5.

A low flange-like riser 61 extends upwardly from the inward or rearward side of the intake face of the RAG 7. The riser 61 extends along the horizontal length of the RAG 7, substantially across the full width of the access opening 39 of the unit. This helps to resist spillage of cold air from the product display space 3. A riser could also, more conventionally, be on the outermost or forward side of the RAG 7 or, as later embodiments will show, a riser 61 could be omitted entirely.

Upper 65 and lower 67 finishers are positioned in front of the DAG 5 and RAG 7 respectively and extend laterally across the full front face of the unit, from one side wall to the other. These finishers 65, 67 provide an aesthetic finish that at least partially conceals the front faces of the DAG 5 and RAG 7, although they could be transparent at least in part. However their main purposes are functional. The finishers 65, 67 serve as barriers to prevent condensation or icing and so they are heated and/or insulated as shown. Alternatives or additions are for the finishers 65, 67 to be of a low-conductivity material and/or to have a high-emissivity finish. Cabinet lighting 15 may be positioned adjacent a finisher 65, 67 to act as a heat source to prevent condensation or icing as FIGS. 12 and 13 will show. At least one of the finishers 65, 67 may also influence the air curtain 9 by virtue of its positioning, orientation and cross-sectional shape, therefore serving as an airflow guide. The finishers 65, 67 are also useful for displaying information about products, promotions and pricing.

The lower edge of the upper finisher 65 covering the face of the DAG 5 preferably lies no more than 10 mm above the discharge face of the DAG 5 or no more than 50 mm below the discharge face of the DAG 5. Its insulated and/or heated front face should be just large enough to prevent condensation yet small enough to maximise visibility and access to the storage area.

The lower finisher 67 covering the face of the RAG 7 has an upwardly- and outwardly-inclined upper portion 63, placing the upper edge of the lower finisher above and outwardly —hence forwardly —with respect to the intake face of the RAG 7. The lower finisher 67 has a lower portion that is generally in the same vertical plane as the upper finisher 65. It follows that the inclined upper portion of the lower finisher 63 lies forwardly with respect to the plane containing the upper finisher 65 and the lower portion of the lower finisher 67.

In the embodiment shown in FIGS. 1 to 7, the lower edge of the upper finisher 65 lies below the discharge face of the DAG 5 and the upper edge of the lower finisher 67 lies above the intake face of the RAG 7. These features may be used individually or in combination. They slightly reduce the total display area and the height of the access opening 39 but they save some energy as a trade-off. They may also help to shape the air curtain 9 projected by the DAG 5 and received by the RAG 7. For example, the upper portion 63 of the lower finisher 67 cooperates with the riser on the other side of the intake face of the RAG 7, splaying apart from the riser to channel air between them from the air curtain 9 into the RAG 7.

Figure 2:
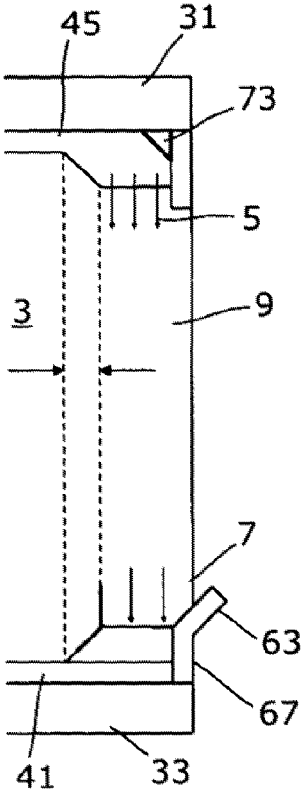
FIG. 2 is a detail view of the front part of the appliance of FIG. 1, showing desirable horizontal spacing between the product display space and the discharge and return air grilles that discharge and receive an air curtain projected across the front of the product display space.

To ensure good and consistent air curtain 9 dynamics, the DAG 5 and RAG 7 should be spaced or offset horizontally in front of the product display space. Ideally the rear sides of the opposed discharge and intake faces of the DAG 5 and RAG 7 should be positioned approximately 20 mm in front of the product display space as shown in FIG. 2 so that any items that may exceptionally protrude from the front of the product display space do not significantly disturb the air curtain 9.

Product loading lines (not shown) may be marked on inner panels of the unit behind the curtain, most suitably on inner side panels. Those lines indicate the maximum forward extent to which shelves or items in the product display space may be positioned. Such lines may have a pear-shaped curvature shaped to match the expected shape of an air curtain 9 allowing for inward deflection, as shown in FIG. 38.

On the basis that there is no provision for air to enter the system elsewhere, the mass flow rate at the DAG 5 must equal the mass flow rate at the opposed RAG 7. The DAG 5 should supply between 50% and 100% of the air collected by the opposed RAG 7, allowing for ambient air entrained into the air curtain 9.

Figure 3:
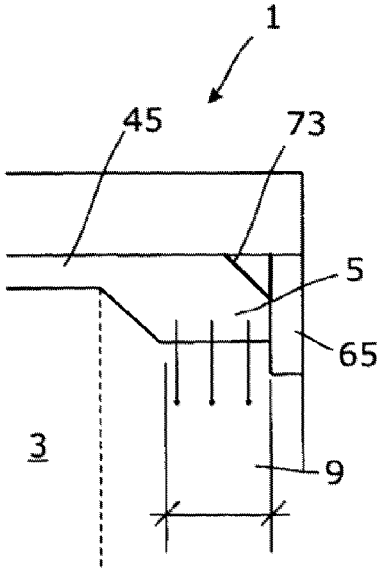
FIG. 3 is a detail view of the front part of the appliance of FIG. 1, showing spacing between opposed faces of the discharge and return air grilles.

The front-to-rear depth or thickness of the air curtain 9, measured horizontally from front to rear across the slot-like discharge face of the DAG 5 as shown in FIG. 3, could be between 40 mm and 250 mm. However, there is a practical optimum discharge slot width which lies around 50 mm or 70 mm to 100 mm measured horizontally from front to rear across the discharge face of the DAG 5.

This slot width, being the dimension from the cold side to the warm side of the discharge face of the DAG 5, determines the thickness of the air curtain 9. Thickness of the air curtain 9 should be maximised for the best thermal efficiency. Greater discharge slot widths enable slower discharge velocities (and so reduced entrainment rates of ambient air) and reduced temperature rises along the length of the curtain 9 from discharge to return.

However, there are limits to increasing slot width and hence air curtain 9 thickness. For example, the discharge velocity cannot be proportionally reduced so as to achieve a stable curtain with the same mass flow rate of air. The wider the DAG 5 from front to rear, the greater the volume flow rate of air that is necessary within the curtain. For example, for a typical, conventional cabinet, doubling the curtain width can lead to 1.6 times the volume flow rate of air, despite the lower discharge velocity required.

Although very thick air curtains 9 are still functional and are more thermally effective than thin air curtains 9, the volume flow rates of air become difficult to handle at the evaporator and require large-volume duct work and high-capacity fans if the discharge slot width of the DAG 5 is increased beyond about 150 mm. The wider the discharge slot of the DAG 5, the slower and more efficient the discharge, but eventually the mass flow of air around the unit imposes a practical minimum discharge velocity on the air curtain 9. The air curtain 9 needs to be driven by momentum and not just by buoyancy.

Also, of course, an excessively thick air curtain 9 tends to separate shoppers undesirably from the products that they wish to browse and purchase.

Reducing the discharge slot width of the DAG 5 instead will enable a stable curtain 9 to be maintained with lower overall volume flow rates of air being circulated and with minimal separation between shoppers and the displayed cold-stored products. The required velocity to maintain stability will, however, start to become sub-optimal for slots narrower than about 50 mm.

The discharge velocity of the air curtain 9 will affect the stability of the curtain, the convective heat transfer coefficient between the curtain and the stored items and the rate of entrainment of ambient air into the curtain 9. It is preferable to minimise the discharge velocity if entrainment of ambient air, and hence also energy consumption, is to be minimised. However, the discharge velocity cannot be reduced too much because otherwise the curtain 9 cannot maintain adequate stability over the full height of the access opening 39. The curtain 9 must also provide adequate cooling to the items exposed near the front of the product display space 3 in order to counter radiative heat gain by the exposed items.

Figure 4:
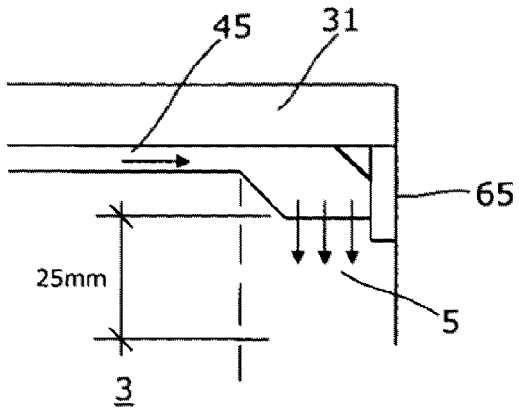
FIG. 4 is a detail view of the discharge air grille of the appliance of FIG. 1, showing the horizontal depth or thickness of the air curtain as measured across the face of the discharge air grille.

The discharge velocity of the air curtain 9, as measured at a point 25 mm below the face of the DAG 5 as shown in FIG. 4, could be between 0.1 m/s and 1.5 m/s. More preferably the initial velocity of the air curtain 9 at that point is between 0.3 m/s and 1.5 m/s and still more preferably between 0.4 or 0.5 m/s and 0.8 m/s, as natural buoyancy may dominate over momentum at lower speeds. Unlike in conventional cabinets, these optimum velocity figures are for a curtain that will remain stable over the full height of the access opening 39 while being substantially without additional support, for example from designed-in back-panel flow. Put another way, the air curtain 9 may be without significant additional support or may be subject to insignificant additional support from supplementary airflow whose primary, dominant or overwhelming purpose is cooling rather than support.

Velocity of the air curtain 9 within these ranges has been found to depend upon the width or depth of the DAG 5 from front to rear, storage temperature, ambient temperature and curtain height. The minimum discharge velocity may be dictated either by curtain stability or product storage temperature. Providing adequate cooling to items in the product display space 3 will depend on curtain mass flow, velocity, temperature, product emissivity, ambient temperature and required product temperature. As a general rule, however, it is optimal to reduce the discharge velocity to the extent that the curtain can just maintain integrity across the height of the access opening 39.

Buoyancy forces are likely to dominate the flow of air curtains 9 with discharge velocities less than 0.4 m/s. Such curtains 9 are likely to have limited practical application although they may be adequate where access openings 39 are particularly short (<0.3 m), the temperature difference between ambient and the product display space 3 is small and the radiative heat gain to the product display space is minimal. Curtains 9 with discharge velocities up to 1.5 m/s may be useful for taller access openings 39 (>0.5 m) but efficiency will be reduced over that velocity. In this respect, it should be noted that if a typical conventional display cabinet was considered without supporting flow behind its air curtain 9, the required discharge velocity would be in the order of 2.5 m/s for a temperature difference between ambient and the product display space of just 13 K. The extreme inefficiency of such a high discharge velocity will be clear, but this simply had to be tolerated before the present invention.

Figure 5:
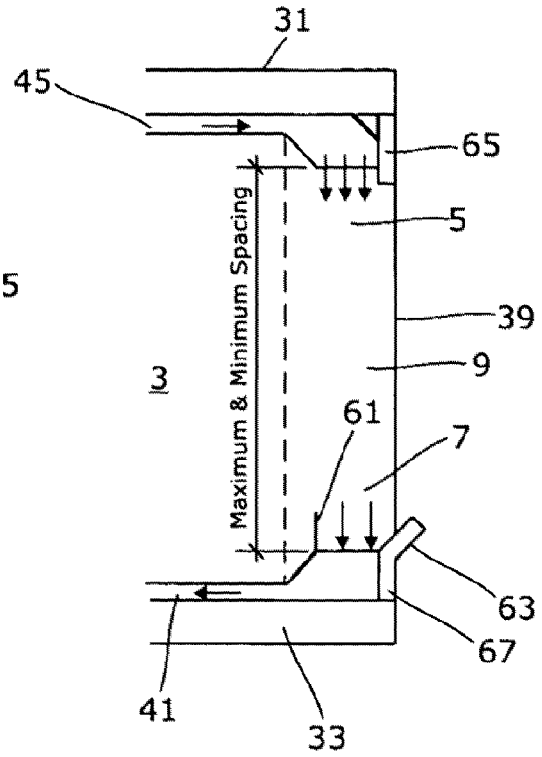
FIG. 5 is a detail view of the discharge air grille of the appliance of FIG. 1, showing where initial velocity of the air curtain may be measured.

The vertical height of the air curtain 9 measured vertically between the opposed faces of the DAG 5 and RAG 7 as shown in FIG. 5 is preferably between 200 mm and 800 mm, but anything greater than 600 mm is likely to be sub-optimal. Conventional air-curtain cabinets typically comprise a significantly longer air curtain 9 than is envisaged in the present invention, to cover an access opening 39 with a height typically greater than 1 m; also, such an air curtain 9 can only perform optimally if supported with measures such as back-panel flow, which are not essential to the invention.

The ratio between curtain height 9 and curtain thickness at discharge of a conventional cabinet is between 10 and 30, with the most common cabinets having a ratio of around 20. In the present invention, the same ratio is generally less than 10, with a ratio of 5 to 7 fitting well with most practical applications. The smaller this ratio, the more effective and so the more efficient the air curtain 9 can be. Curtain thickness at discharge may otherwise be expressed as the effective width of the discharge face of the DAG 5 from front to rear, or the slot width of the DAG 5.

The design of the RAG 7 per se has been found to have little effect on energy consumption provided that any pressure drops are equal (and hence airflows are balanced) across its width from side to side viewed from the front of the unit. However, the orientation and position of the RAG 7 and of any associated airflow-guide structures may be significant, as will be explained later in this specification. The optimum depth or width of the RAG 7 from front to rear is close to the width of the DAG 5 in that direction but it could be less —for example about two-thirds of the width of the DAG 5, although testing is needed to verify this. This is in contrast to conventional cabinets in which the return air terminal is generally wider from front to rear than the discharge air slot, due in part to the presence of supporting air flows that must return in addition to the air curtain 9. Such supporting air flows are not an essential feature of the present invention; to the contrary, they are preferably omitted. Testing has shown that the efficiency and stability of the air curtain 9 is less sensitive to width reduction at the RAG 7 than at the DAG 5, with initial data implying that an optimum RAG 7 width may be slightly narrower than the DAG 5 width measured from front to rear.

The Richardson Number is a dimensionless number defined as the ratio of buoyancy forces to momentum forces, which may also be used to characterise an air curtain 9 in accordance with the invention. One definition of the Richardson Number that considers the fundamental variable of DAG 5 slot width measured from front to rear is:

$$Ri = \frac{Gr}{\mathrm{Re}^2} = \frac{g\beta(T_{ae} - T_o)H^3}{U_0^2 b^2}$$

Ri=Richardson Number
Gr=Grashof Number
Re=Reynolds Number
g=gravitational acceleration ($m \cdot s^{-2}$)
β=thermal expansion co-efficient ($K^{-1}$)
$T_{ae}$=ambient temperature (° C.)
$T_0$=discharge temperature of curtain (° C.)
H=curtain height (m)
$U_0$=discharge velocity of the air curtain ($m \cdot s^{-1}$)
b=discharge air grille width (m)

With so many variables, the Richardson Number of an air curtain 9 will vary during normal operation of a refrigerated display unit, due to matters such as fluctuation in the discharge velocity as the evaporator frosts, and varying ambient and storage temperatures. Consequently, specifying a design point is not always straightforward.

For the most common conventional cabinets, the Richardson Number is typically around 1400 to 1800. In order to minimise energy consumption, it is important to maximise the Richardson Number of an air curtain 9 as this represents a low discharge velocity. However, high Richardson Numbers are associated with unstable curtains, and so it is desirable from a stability viewpoint to minimise the Richardson Number. In the context of the present invention, Richardson Numbers in the range of 40 to 60 are likely to be well suited to a refrigerated retail display unit whereas Richardson Numbers over 120 are unlikely to have practical application.

The Richardson Number should be used with some caution but it can be a useful analytical tool nevertheless if its limitations are understood. For example, $U_0b^2$ in the denominator may not be a truly representative correlation for the discharge velocity and DAG 5 width. In this respect, it is noted that a wider DAG 5 requires greater mass flow overall because constant mass flow does not provide constant stability for varying DAG 5 width. Also, as the temperature difference in the numerator approaches zero, it becomes less meaningful as it is not capable of modelling an isothermal free jet—which is a function of H/b and turbulence in this case. However the Richardson Number can be correlated approximately with the stability or deflection of an air curtain 9 and it provides a convenient comparison of air curtains 9 for largely similar applications.

Figure 6:
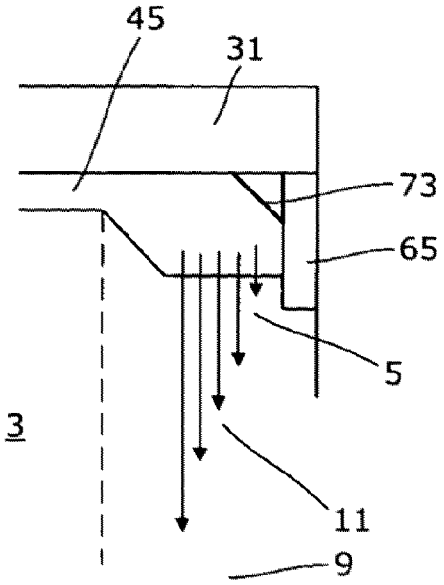
FIG. 6 is a detail view of the discharge air grille of FIG. 4 and FIG. 5, showing a preferred velocity profile across the thickness of the air curtain.

FIG. 6 shows that it is desirable to have a velocity profile 11 in which the outwardly-facing side of the air curtain 9 is at a lower velocity than the inwardly-facing side of the air curtain 9. In this case, references in this specification to the velocity of the air curtain 9 are to the average velocity across the depth of the air curtain 9. The chamfered bend and the opposed corner fillet 73 of the plenum above the DAG 5 help to achieve this velocity profile.

A slower outwardly-facing side of the air curtain 9 has less dynamic interaction with the ambient air and so will reduce the rate at which ambient air is entrained. Dynamic interaction with the ambient air and hence entrainment will also be reduced by providing smooth airflow through the DAG 5, with laminar flow being ideal. For this purpose, the above features of the plenum associated with the DAG 5 should be coupled with a suitably-sized discharge honeycomb 53 of vertically-extending channels in the DAG 5, which also helps to smooth the airflow. Thus, the DAG 5 is essentially a low velocity device that needs to project a low-turbulence (or largely laminar) air stream to seal the access opening 39 down to the level of the RAG 7.

A velocity profile 11 skewed to the cold side improves the efficiency of the refrigerated cabinet; the faster velocity on the cold side enhances the convective heat transfer between the air curtain 9 and the items stored in the product display space 3, in addition to the reduced velocity on the warm side minimising entrainment of ambient air.

Figure 7:
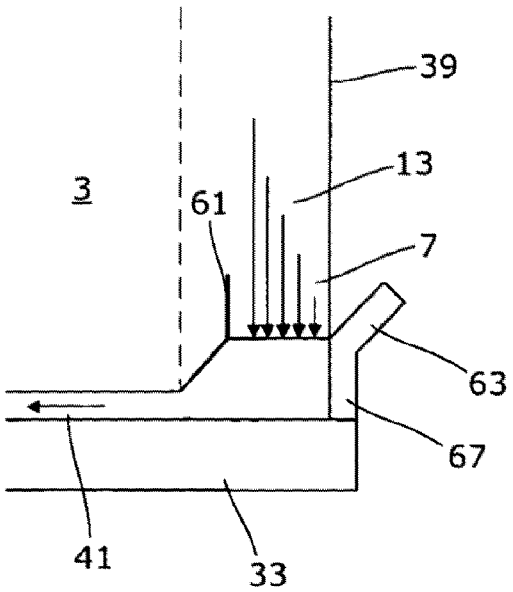
FIG. 7 is a detail view of the return air grille of the appliance of FIG. 1, also showing the preferred velocity profile in the air curtain of FIG. 6.

FIG. 7 shows that whilst minimal pressure restriction is preferred at the RAG 7, it may be useful to have a velocity profile 13 at the RAG 7 akin to that produced at the DAG 5. Colder air on the inner side of the air curtain 9 facing the product display space 3 will tend to promote this profile in any event. This helps to maintain a desirably high heat transfer co-efficient from the product display space 3 to the air curtain 9.

FIGS. 8 to 11 show various possible adaptations to the DAG 5 to condition the airflow and to promote low-turbulence flow, preferably with the desirable velocity profile 11 shown in FIG. 6. These adaptations may, for example, involve air guides, splitters and/or turning vanes. Honeycomb 53 inserts may be used in the DAG 5 to minimise turbulence and to balance the discharge velocity along the length of the DAG 5, from left to right across the width of the access opening 39. Angles of corner baffles 55 above the DAG 5 can affect the discharge velocity profile of the air curtain 9, which can be advantageous if applied correctly as noted above.

Figure 8:
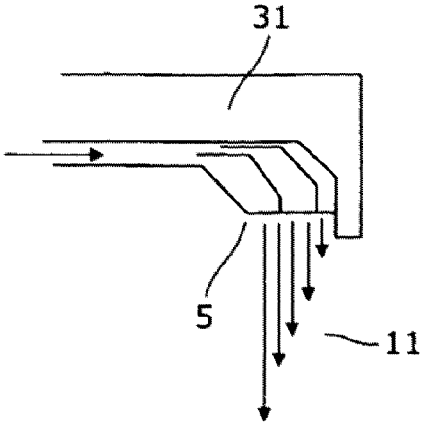
FIGS. 8, 9, 10 and 11 are sectional detail side views showing various adaptations to the discharge air grille to promote low-turbulence flow and the preferred velocity profile in the air curtain.
Figure 8:
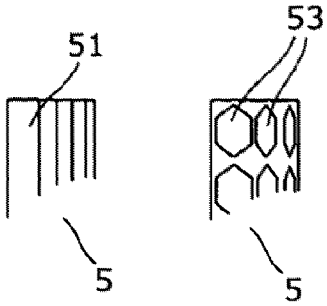

FIG. 8 shows that the DAG 5 can have graduated divider plates 51 or honeycomb 53 slots to assist air flow directivity, and profiled discharge velocity.

Figure 9:
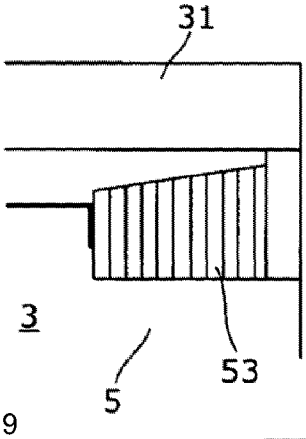

FIG. 9 shows a uniform horizontal honeycomb 53 in the DAG 5 with a wedge-shaped upper surface rising toward the front of the unit.

Figure 10:
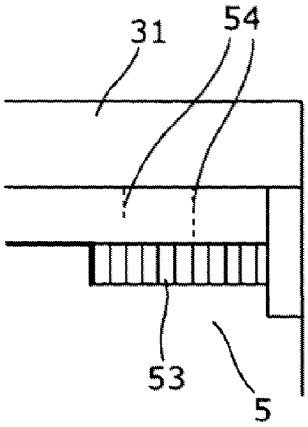

FIG. 10 shows a uniform, horizontal and generally flat honeycomb 53 in the DAG 5 with a succession of spaced perforated plates 54 in the plenum above; the perforated plates may increase in length toward the front of the unit as shown.

Figure 11:
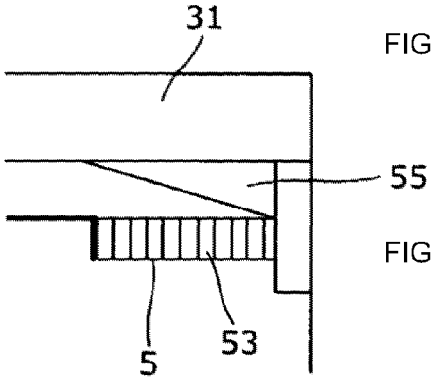

FIG. 11 shows a uniform, horizontal and generally flat honeycomb 53 in the DAG 5 with a wedge-shaped insert 55 in the plenum above, whose lower surface falls toward the front of the unit. The lower surface of the insert shown in FIG. 11 is generally planar but it could be convex- or concave-curved in the front-rear direction with respect to the unit.

Figure 12:
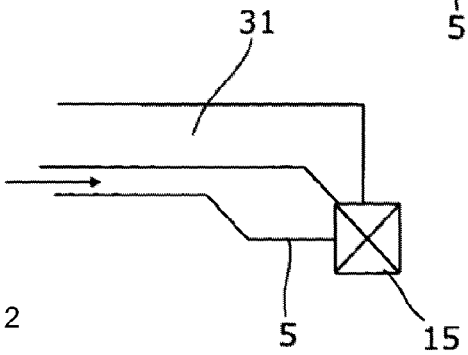
FIGS. 12 and 13 are sectional detail side views showing possible locations for cabinet lighting adjacent the discharge air grille.
Figure 13:
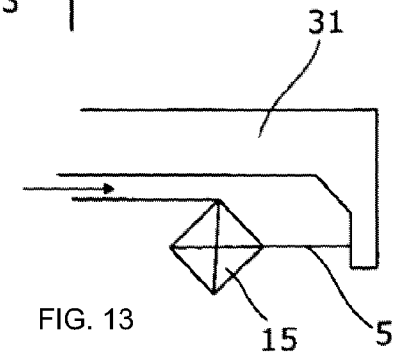

FIGS. 12 and 13 show possible locations for cabinet lighting 15 adjacent the DAG 5. FIG. 12 shows strip lighting, preferably comprising LED arrays, that serves as part of an upper finisher positioned to the front of the DAG 5. Positioned here, the strip lighting 15 contributes insulating and heating effects appropriate for an upper finisher. Conversely, FIG. 13 shows strip lighting 15 positioned to the rear of the DAG 5, under a chamfered corner 55 between the DAG 5 and the supply duct. A separate insulated and/or heated upper finisher is positioned to the front of the DAG 5 in this case.

Figure 14:
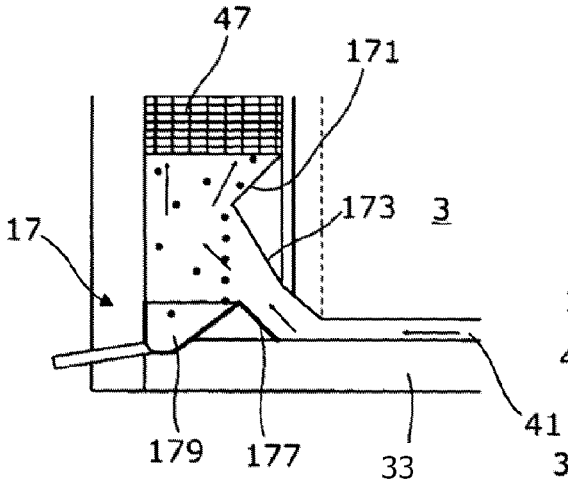
FIG. 14 is an enlarged detail view of a drainage system of the appliance of FIG. 1.
Figure 15:
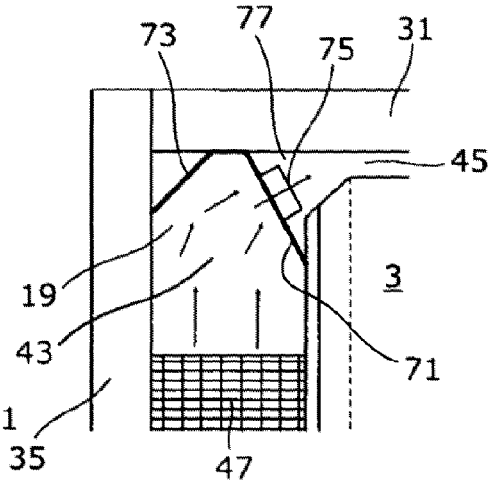
FIG. 15 is an enlarged detail view of an impeller system of the appliance of FIG. 1.

FIGS. 14 and 15 show that it is desirable to have airflow management such as chamfered or rounded corners around drain trays 17 and at cooling coils 47, fans 75 and transition ducts 73, 77 to maintain smooth air pattern characteristics and low static resistance. Adequate duct width is also important. Enhancements such as these minimise turbulence in, and pressure drop through, air ducts around the unit. Good air flow design practice is particularly important at bends to minimise flow disturbance and pressure loss.

Referring specifically to FIG. 14, this shows a possible drainage arrangement 17 beneath the cooling coil 47, in the corner at the junction between the bottom and back return ducts of the unit. Moisture dripping from the cooling coil 47 is deflected rearwardly by a deflector plate 171 that extends from the insulated inner panel of the back wall rearwardly and downwardly into the back return duct. An angled fillet 173 extends forwardly and downwardly from near the rear edge of the deflector plate 171 to a chamfered corner 177 between the bottom and back return ducts. The fillet and the chamfered corner 177 smooth air flow at the corner transition.

The rear edge of the deflector plate 171 lies over a drain tray 179 at the corner between the insulation of the bottom and back walls of the unit. The drain tray 179 incorporates an inclined element creating a 'fall' to a low discharge point comprising a drain pipe at the rear of the unit to reject water and to prevent idle water traps that could otherwise encourage microbial growth within the air ducts of the unit. The front of the inclined element of the drain tray 179 has an integral fillet extending forwardly and downwardly to the insulation of the bottom wall. The fillet is opposed to the chamfered corner to effect a smooth change in the direction of the air flow.

Drains 17 and cooling coils 47 may require heaters 221 to defrost ice accumulations where temperatures are low enough to allow local freezing. This is described more fully later with reference to FIG. 34.

Moving on now to FIG. 15, this shows an impeller 75 arrangement at the top of the back return duct, in the corner 19 at the junction between the back return duct 41 and the supply 45 duct of the unit. An angled fillet 73 extends across the corner between the insulation of the back and top walls of the unit. The fillet 73 is an integral element of a plate, the plate also having a support element 71 extending forwardly and downwardly from the insulation of the top wall to the inner panel of the back wall. The support element 71 supports a row of fans 75 (only one of which is visible in this side view), positioned in respective openings in the support element 71; otherwise, the support element 71 seals the back return duct 41 from the supply duct 45. Again, a chamfered corner 77 between the back return duct 41 and the supply duct 45 cooperates with the fillet to smooth air flow at the corner transition 19.

FIG. 16 shows that one or more intermediate shelves 21 may be located within the cold storage cavity 3, for example to display different types of food products and to make best use of the available space. One or more of the intermediate shelves 21 may be perforated or slotted as shown to improve air movement in the cold storage space. Such a shelf need not seal against the back or side walls.

FIG. 17 is a front view of the unit of showing a side-mounted refrigerator engine 23 behind a grille for exhausting warm air, with the access opening 39 to the product display space disposed beside it. It is emphasised that the refrigerator engine 23 could be located to the top, bottom, left, right, or rear of the casing. It is also reiterated that the integral refrigerator engine 23 is optional and that cooling could instead be supplied from a remotely located refrigerator engine or from common cooling circuits.

It will now be explained how the principles of a modular plurality of units may be used to create an integrated multi-cellular display appliance. Reference is made to FIGS. 18 to 33 of the drawings in this respect. Like numerals are used for like parts.

It will by now be clear that air curtain 9 stability is important to counter the forces of the stack effect, to retain colder-than-ambient air inside the product display space 3 and to prevent the infiltration of ambient air. The magnitude of the stack effect depends upon the temperature difference between the ambient air and the chilled air inside the cabinet, and the height of the access opening 39 of the cabinet.

Where the chilled cavity 3 of a cabinet is subdivided into a series or array of smaller cavities such that air substantially cannot transfer between adjacent cavities other than via their open fronts, the height that influences the stack effect is the height of the individual cavity or cell. The present invention takes advantage of the reduced cavity height to minimise the consequences of the stack effect. In the present invention, air curtains 9 therefore have a reduced initial momentum requirement compared to conventional cabinets, assuming the same differential between storage temperature and ambient temperature.

FIG. 18 shows a refrigerated display appliance 1 that has a bottom-mounted refrigerator engine 23 and a plurality of airflow-managed cells 3*a*, 3*b*, 3*c* stacked in a vertical array or column and all sharing a single insulated cabinet.

The top wall of a lower cell and the bottom wall of an adjacent upper cell (say 3*b* and 3*c*) of the array together define a shelf. The shelves subdivide the internal volume of the cabinet into a plurality of product display spaces stacked one atop another, each in its own airflow-managed cell. At their back and side edges, the shelves lie closely against the back inner panel and the side walls of the cabinet, to discourage airflow around those edges of the shelves. Seals may be provided along those edges of the shelves if required.

Again, one or both of the side walls could be transparent to enhance visibility of items displayed within the cabinet, in which case the side walls are suitably of tempered glass and double- or triple-glazed.

In this example, three airflow-managed cells 3*a*, 3*b*, 3*c* are stacked within the encompassing cabinet: an uppermost cell 3*a*; and inner cell 3*b*; and a lowermost cell 3*c*. In other examples having more than three cells in the stack, there will be more than one inner cell; conversely where there are only two cells in the stack, there will be no inner cell.

Cells can be of different heights and may be arranged to store items at different temperatures to reflect different storage requirements for different items.

The inner airflow-managed cell 3*b* in sectional side view in FIG. 19 shows how each cell is essentially similar to an individual appliance as shown in FIG. 1, except that the cells omit the thick insulating members on the top and/or bottom walls. Thinner insulation, or no insulation, is used instead at the top and/or bottom walls from which thick insulation is omitted. This is the case for both the top and the bottom walls of inner cells 3*b*, being cells other than those at the top and bottom of the stack. In contrast, the uppermost cell 3*a* will have thick insulation in its top wall and the lowermost cell 3*c* will have thick insulation in its bottom wall. The thick insulation at those locations and on the back walls of the cells may be considered as part of the cabinet that surrounds a plurality of the cells.

The airflow-managed cells of the invention can also be fitted to conventional insulated cabinets or retrofitted to existing retail display cabinets. In these applications, the cells do not require the thick insulation component on the back wall because the necessary insulation is already present as part of the common cabinet casing.

FIG. 20 shows how the cells of FIG. 19 may be stacked to fill the internal volume 3 of the cabinet 1. Air is cooled and circulated locally in this example although cooling air could instead be ducted remotely to and from each cell. Thus, the refrigerator engine 23 can be included in the casing as an integral unit or cooling can be supplied remotely from a typical supermarket refrigeration pack unit.

Here, local cooling coils 47 and fans are advantageously located behind the cells as shown as this reduces the bulk of the shelves and maximises access to the displayed items, but cooling coils 47 and/or fans could instead be situated to the top, bottom or sides of a cell 3*a*, 3*b*, 3*c*. Local cooling necessitates a drainage system 17, shown in this example to the bottom rear corner of each cell. The features of the drainage system 17 are as explained previously with reference to FIG. 14 and need not be repeated here.

In essence, the stacked cells create a succession of small air curtains 9 between the shelves inside the refrigerated cabinet. The air curtains 9 are produced by providing air outlets (DAGs 5) and air inlets (RAGs 7) in the front part of each shelf, communicating respectively with a supply duct 45 and a return duct 41 defined by respective channels within the shelf that in turn communicate with ducts in the cabinet structure supporting the shelves.

The features of the DAG 5 and RAG 7 of each shelf and their associated plenums and communicating ducts shown here are much the same as in their counterparts in the embodiment shown in FIGS. 1 to 17. The optional features explained in relation to that embodiment may also be adopted here.

This arrangement is best appreciated in the enlarged detail view of FIG. 21. In this simple expression of the idea, a single return duct 41 is above a single supply duct 45 in a bi-level layered arrangement. However, other arrangements are possible in which the return duct 41 is beside the supply duct 45 on the same horizontal level or on overlapping levels in the shelf. Also, there may be more than one supply duct 45 or return 41 duct per shelf, or those ducts may be divided into branches.

Adjoining walls and their surfaces between air ducts in the shelf at different temperatures should be of low heat conducting materials and/or insulated and/or heated to discourage condensation in the warmer duct. The warmer duct is normally the return duct 41, where infiltration gains will tend to raise moisture levels and proximity to the colder supply 45 duct could otherwise encourage that moisture to condense.

In another approach to deal with any condensation that may form, in-shelf ducts may be provided with drainage means to collect moisture and to drain it away. For example, a return duct 41 in a shelf could be inclined slightly downwardly and rearwardly to fall toward the rear of the cabinet, where it may connect to the drainage system provided for the cooling coil 47 to reject water from the cabinet.

The upper and lower finishers positioned in front of the DAG 5 and RAG 7 in the embodiment shown in FIGS. 1 to 17 are replicated here and have similar features, but in this case they are integrated into a single finisher 67 at the front of each shelf. That finisher 67 comprises an upwardly- and outwardly-inclined upper portion, placing the upper edge of the finisher above and forward of the intake face of the RAG 7 of the associated shelf. An integral lower 63 portion of the finisher 67 extends slightly below the discharge face of the DAG 5 of the associate shelf. Separate upper and lower finishers 65, 67 like those of the first embodiment are used in front of the uppermost DAG 5 and the lowermost RAG 7 of the array.

The variant illustrated in FIGS. 22 to 30 shows that the cells need not have individual cooling coils 47: the cabinet in this instance has a common cooling coil 47 that may, for example, be located in the base of the unit. The ventilated, ducted shelves connect to common ducts and supply air to the air curtains 9 and return air from the air curtains 9. Cold supply air is therefore ducted from the common cooling coil 47 to each cell and warmer return air is returned from each cell to the coil for cooling, drying, optional filtering and recirculation. Indeed, cold air may be ducted to each cell from a remote or shared source outside the unit and recirculated through that source for re-cooling and other processing.

More specifically, FIGS. 22 and 23 show common parallel vertical supply and return air distribution ducts connecting to and shared by the airflow-managed cells. In this instance the supply duct 45 is located centrally with respect to the shelves and lies between two return air ducts, those ducts all being defined between a back inner panel and the insulation in the back wall of the cabinet. Other duct arrangements are of course possible. As in the first embodiment, the back inner panel may be thinly insulated and/or heated to avoid overcooling in regions remote from heat gain through the access opening 39. However, insulation or heating may not be necessary if the supply and return ducts lie behind the back inner panel as separate components rather than being partially defined by the back inner panel itself.

FIGS. 24 and 25 illustrate airflow arrangements within the appliance of FIG. 22. There are many possible variations of air distribution and air path circulation to serve each airflow-managed cell but one possible arrangement is set out in the airflow distribution diagram of FIG. 24. This shows how the vertical supply and return ducts behind the back inner panel connect to a cabinet comprising three such cells as described above.

FIG. 25 shows in diagrammatic plan view how the supply and return ducts behind the back inner panel connect to the common cooling coil 47 and air circulation fans in the base of the cabinet below the lowermost cell. Air is drawn by fans through an evaporator coil that cools the supply air, which the fans then propel up the central supply duct. From there, the air enters the supply ducts of the shelves and the top wall of the cabinet, is projected as a stack of air curtains 9, one per cell, and is returned via return ducts in the shelves to the return ducts on each side of the central supply duct behind the back inner panel. The return air flows downwardly in those return ducts and around a shroud disposed in the base of the cabinet around the fans and the evaporator coil, to enter the evaporator coil again under the suction of the fans.

It is possible for the shelves to be fixed but it is preferred for the shelves to be removable. More preferably, the shelves are movable and reattachable at different vertical positions to allow easy adjustment of their height and hence the height of each airflow-managed cell.

A simple arrangement for achieving height adjustment is shown in FIG. 26. Here, the back inner panel of the cabinet has several mounting positions that can hold the shelves 121 at different heights. The shelf support system comprises hook-on brackets 123 cantilevered from the back of each shelf, that hook into complementary holes 125 punched in the back inner panel or in vertical supports (not shown) that may be attached to the back inner panel for greater strength.

The use of such brackets and supports 123 is well known in the art of retail display cabinets for positioning adjustable shelves 121. However, the requirement in this embodiment for airflow to the shelves 121 also demands associated ports leading to the supply and return air ducts behind the back inner panel. Those ports are spaced in vertical arrays aligned with the parallel vertically-extending supply and return air ducts behind the back inner panel. Advantageously, those ports are open only when a shelf is coupled with them to reduce unwanted spillage of cold air into the product display space of the cabinet. Reference is also now made to FIGS. 27 and 28 in this respect.

For this purpose, the back inner panel comprises a thin flexible, resilient material such as spring steel or plastics that is laser-cut or CNC-punched to form flap valve openings for the air duct connections of the shelves. Each port opening 127 is cut not as a complete hole, but as an elongated 'U' shape. The flap formed by the 'U' cut is pushed back by a corresponding spigot on the rear of the shelf 121 when the shelf 121 is hung on the back inner wall. The spigot contains an opening that communicates with a supply or return duct in the shelf 121, allowing airflow in the appropriate direction between the ducts of the shelf and the corresponding ducts behind the back inner panel.

The shelf 121 has more than one such spigot, each leading to a respective duct in the shelf and being positioned to align with and cooperate with a corresponding port in the back inner panel and a corresponding distribution duct behind that port. In this case the shelf has three spigots on its rear edge, a central one being for alignment with the central supply duct and the other two being for alignment with the return ducts on each side of the central supply duct behind the back inner panel. When the shelf is removed, the spigots disengage from the ports and the flaps spring back into the general plane of the back inner panel to return to the closed position, substantially sealing the ports.

FIGS. 29 and 30 elaborate on FIG. 23 and show, respectively, the supply and return ducts of a shelf disposed in the aforementioned bi-level arrangement. FIGS. 27 and 28 also show how the supply and return ducts of the shelf communicate with the respective associated spigots at the back edge of the shelf.

The cut line for the 'U' shape should be as narrow as possible to minimise air leakage through the back inner panel when a flap valve is closed. For that purpose, it is possible to surround the flap valves with seals. It is also possible to fit the flap valves with magnets to hold them closed unless the spigots of a shelf push them open. However any air that does leak through the back inner panel may usefully help to cool the contents of the cabinet.

These simple flap valves in the back inner panel provide a low-cost and reliable basis for the adjustable shelf concept of the invention. However other forms of hinged, rotating or sliding port covers or valves may be envisaged instead, as can the use of plugs to block any unused ports.

The back inner panel may have power supply elements such as vertical strip contacts (not shown) at low voltage, typically 12V, cooperable with complementary electric terminals on a shelf. When the shelf is plugged into the back inner panel, the terminals connect to the contacts to conduct electricity required to power electrical systems in the shelf such as lighting, heating and control elements. In another option, electrical connections could be effected via the cooperable fixings used to support the shelves.

Turning now to FIGS. 31 to 33 of the drawings, these show that airflow-managed cells may also be disposed side-by-side while all sharing a single insulated cabinet of one refrigerated display appliance 1. In this example, a plurality of airflow-managed cells are arranged in three vertical arrays or columns 201, 203, 205, each of which comprises a smaller plurality or subset of cells. Each column has a central supply duct between two return ducts behind its back inner panel as best shown in FIG. 32, with vertical arrays of ports aligned with and communicating with each of those ducts as best shown in FIG. 33. FIG. 33 also shows vertical arrays of mounting holes whereby the height of the shelves is adjustable.

Adjacent columns are separated and partially defined by a substantially vertical partition 137 that lies in a plane orthogonal to the plane of the back inner panel. There are therefore two such partitions 137 in this example, lying in mutually-spaced, parallel and substantially vertical planes.

Whilst the appliance shown in FIGS. 31 to 33 has solid opaque insulated side walls 37, it would be possible for one or both of the side walls 37 to be transparent instead to enhance the visibility of items displayed in the cabinet. Such an arrangement is shown in FIGS. 41 and 42. Again, if transparent, the side walls could be of tempered glass and double- or triple-glazed. Similarly to enhance visibility of the items displayed in the cabinet, the partitions 137 are advantageously transparent as shown and are also preferably of tempered glass. As the partitions could allow side-by-side cells to be set to different storage temperatures, they may beneficially have insulating properties such as by being double- or triple-glazed if they are transparent.

Outer columns 201, 205 are defined between a side wall and a parallel partition; inner columns 201 are defined between two such partitions. To illustrate the flexibility of the invention, the two outer columns 201, 205 shown in FIG. 31 each have three shelves 121 that together define four cells, and the inner column has two shelves that together define three cells. It can be seen how the heights of the cells may vary considerably from cell to cell and from column to column. For versatility in this respect, it is highly desirable that shelves are removable and that shelf heights are adjustable, for example by using adjustment solutions as described above and shown in FIGS. 32 and 33.

The number of columns is largely immaterial, There could be just two columns, one to each side as outer columns, with no inner column between them; or there could be more than three columns, with more than one inner column between two outer columns. For ready scalability, columns could be added to an existing appliance simply by incorporating suitable additional components in a modular fashion to extend the appliance widthways while using the same side walls.

The number of shelves and cells in each column is also largely immaterial, provided that adequate access and air curtain 9 sealing can be assured. Indeed, there need not be more than one cell in any given column and hence possibly no shelves at all. The simplest expression of the side-by-side cell concept is to have two cells beside each other and separated from each other by a partition in a surrounding insulated open-fronted cabinet.

At its rear edge, each partition lies closely against, and is preferably sealed to, the back inner panel. The partitions extend from the back inner panel substantially the full depth of the shelves from front to rear. Preferably, as shown, each partition extends slightly forward of the front edge of a shelf, at least as far as the forward edge of the forwardly-extending upper portion of the finisher on the front of the shelf.

The partitions prevent air flows from spilling from one column to the next and possibly disrupting the air curtain 9 dynamics of adjacent cells. This helps to prevent the performance of each air curtain 9 being affected by ambient air currents or by an adjacent air curtain 9. The partitions also help to minimise cross-contamination between cells and to contain any spillages that may arise from items displayed within a cell.

At their back and side edges, the shelves lie closely against the back inner panel and the side walls of the cabinet and/or against the partitions, to discourage airflow around those edges of the shelves. Seals may be provided along those edges of the shelves if required. The front edge region of each partition should be insulated and/or heated to fight condensation. It is also possible for the front edge region of each partition to be of a low-conductivity material and/or to have a high-emissivity finish.

In contrast to a conventional cabinet in which the RAG 7 usually connects to the front of the cabinet to duct air into the cooling coil 47, cells of the invention have return air ducts that extend back to the rear of the unit and from there to the cooling coil 47.

Some variations have been described above; many other variations are possible without departing from the inventive concept.

For example, FIGS. 34 and 35 illustrate alternative drainage and defrosting arrangements applied to the first embodiment, although it will be clear that similar features may be applied to other embodiments too.

On units that operate above zero Celsius, defrost may be achieved simply by deactivating the cooling coil 47 and continuing to circulate air over the coil. Where this is not possible, heat may be applied as shown in FIG. 34. In this example, electric or hot gas heating elements such as rods or pipes on the coil and drain surfaces defrost any ice build-up at those locations. Additionally, a butterfly-valve damper above the cooling coil 47 in the back return duct, which is normally kept open by being aligned with the airflow in that duct, is turned through 90° to block the airflow in the duct during the defrost process and hence to prevent convective circulation.

The rear view of FIG. 35 shows multiple centrifugal fans that facilitate even distribution of airflow along the linear length of the air curtain 9. Alternatively, tangential fans can be used. FIG. 35 also shows how the drain tray or trough has an inclined 'fall' toward the drain pipe from one side of the appliance to the other. An alternative drain tray with oppositely-inclined arms converging on a central drain pipe is shown below.

The variant shown in FIG. 36 addresses the problem that items stored at the front of the product display space near the access opening 39 will be most affected by ambient radiant heat gains through the access opening 39. Such heat gains may be largely or partly offset by introducing some radiant cooling surfaces 333, shown here in the forward region of the top and bottom inner panel and also in the forward region of an intermediate shelf that divides the product display space. The vertical partitions of the embodiment shown in FIGS. 31 to 33 may also have radiant cooling surfaces in their forward regions.

Radiant cooling can most simply be achieved by conduction along a metal sheet with matt black surfaces for cold radiation. It is also possible for radiating surfaces 333 to have additional cooling pipes or panels.

Where insulation is provided on an inner panel of the unit, the insulation may be non-uniform across the panel to suit the heat gain expected at different locations within the unit. As an example, insulation may become thicker with increasing distance from the access opening 39, to tailor the local temperature of the inner panel to suit the heat gain expected at that location. Conversely, the conductivity of a non-insulated inner panel could be tailored in a similar manner.

Similarly, any trace heating provisions for an inner panel may also have non-uniform effect across the panel, for example with different thicknesses or densities of heating elements at different locations on the panel. It is also possible for the degree of trace heating across an inner panel to be variable and controllable to tailor the temperature profile across the panel, for example by switching on different numbers of heating elements at different locations on the panel. This can be used tailor the local temperature of the inner panel to suit the heat gain encountered at that location.

Where an inner panel is penetrated by openings such as perforations communicating with the duct behind to admit cooling air to the product display space, the size or density of the perforations may vary between different locations on the panel. Again, this can be used to suit the heat gain encountered at that location.

FIG. 37 confirms that the front of a refrigerated display appliance may be planar or otherwise straight from side 37 to side 37 as shown in the top illustration. However, the front of the appliance may depart from a straight line or plane with, for example, a generally convex centrally-protruding shape as shown in the middle and bottom illustrations of FIG. 37. The middle illustration in FIG. 37 shows a segmented front profile with oppositely-inclined side parts on either side of a central straight part. In contrast, the bottom illustration in FIG. 37 shows an arcuate front profile, in this example substantially semi-circular in plan view. A generally concave, centrally-recessed shape is also possible in principle. In each case, the air curtain 9 and the finishers 67 follow the plan shape of the front of the appliance at that location.

Shelves 21 could support drawers or other open-topped containers to retain cold air, and shelves or such drawers or containers could be fitted with self-fronting systems, such as an inclined base that propels items forward under gravity as other items are picked from the front.

Provision may be made for shelves to slide forwardly on drawer-like runners for cleaning, maintenance and restocking. A ducted shelf can slide as a whole, including the spigots connecting through the flap valves of the ports to the supply and return ducts behind the back inner panel. As noted above, the flap valves will close upon withdrawal of the spigots from the ports to shut off the air supply to the shelf when slid forward. Alternatively, a sliding tray element may slide forwardly over and away from a ducted shelf while the shelf remains in situ in communication with the supply and return ducts behind the back inner panel.

In a further possible variant, a minor secondary air jet (which could even be at or above ambient temperature) could be projected in front of the main air curtain 9 to prevent condensation on the finishers positioned in front of the DAGs 5 and RAGs 7.

FIG. 38 shows the dynamic and thermal forces affecting the air curtain 9. Differently-shaded bands in the air curtain 9 signify isotherms, with the colder temperatures being on the inner or rearward side of the air curtain 9 facing the product display space.

It is known in the prior art that the discharge angle of an air curtain 9 can be altered to improve the stability of the air curtain 9. This is particularly applicable to long curtains that span tall access openings 39 as in the prior art. Where such a curtain seals a cold cavity in the prior art, it may be advantageous to incline the curtain towards the warm side; that is, outwardly or forwardly with respect to the cold cavity of the unit. Inclining the curtain in that way has been found to maintain stability with slower discharge velocities, with 15° to 20° from the vertical being regarded as an optimum.

In view of the short throw distances and low velocities that characterise the invention, skewing the air curtain 9 either inwardly or outwardly at the DAG 5 would generally be detrimental to efficiency, unless protrusions from the product display space due to poor product loading would otherwise disturb the air curtain 9 flow. Consequently, it is preferred that the discharge air direction is substantially vertically downward, within preferably plus or minus 30° of vertical and more preferably within 20°, 15° or 10° of vertical.

Verticality in this context applies to a situation as illustrated where the DAG 5 is substantially directly over the RAG 7. However, expressed more generally, it would be possible for the RAG 7 to be horizontally offset with respect to the DAG 5 and, therefore, for a straight line between the DAG 5 and the RAG 7 to be inclined with respect to the vertical. It is therefore preferred that the discharge air direction is substantially aligned with a straight line connecting the DAG 5 and the RAG 7 or at least within plus or minus 30° of that line and more preferably within 20°, 15° or 10° of that line.

In an ideal air curtain 9, 100% of the air projected from the DAG 5 would be captured by the RAG 7. Additionally the RAG 7 would only capture air projected from the DAG 5 with no entrainment or other air volume/mass gains. In other words, the air curtain 9 should ideally behave like a closed circulating loop.

In reality, however, an air curtain 9 is an open circuit in which—in an extreme theoretical worst-case scenario—up to 100% of the supply air projected by the DAG 5 could be lost and not returned via the RAG 7. Factors that could contribute to the loss of supply air are: throw (the distance covered by the air curtain 9); turbulence (non-laminar air flow, shearing etc); directivity (wrong shape or direction of the air curtain 9); heat transfer (temperature and moisture gains); stack effect (driven by differential temperatures across the height of the access opening 39); and poor RAG 7 capture (air curtain 9 not captured effectively).

An objective of the invention is to minimise the loss of supply air and to move closer to the ideal in which most of the air projected from the DAG 5 is captured by the RAG 7 with minimal capture of entrained ambient air. In this respect, FIG. 38 shows a typical velocity profile around the RAG 7, which demonstrates that suction or extract terminals such as a RAG 7 have limited directivity. The influence of the RAG 7 on surrounding airflows is very localised and its effectiveness depends largely on its location and the complimentary projection from the DAG 5.

Referring to the temperature profile of the air curtain 9, there may be benefit in changing the position and orientation of the RAG 7 and of the associated finisher and riser that serve as air guides around the RAG 7. For example, an outwardly-projecting air-guiding finisher 67 may inadvertently capture some of the ambient air that is inevitably entrained in the forward side of the air curtain 9. Also the localised velocity profiles around the RAG 7 have influence within the entrained ambient air in the forward side of the air curtain 9, which may also tend to draw in some of that entrained ambient air.

In view of these observations, FIGS. 39 and 40 show optional variants in which the intake face of the RAG 7 faces rearwardly toward the product display space to some extent. FIG. 39 shows the intake face of the RAG 7 facing rearwardly to a lesser extent, being also inclined upwardly. FIG. 40 shows the intake face of the RAG 7 facing rearwardly to a greater extent, with substantially no upward inclination. Also, in both of these variants, the finisher associated with the RAG 7 has an upper air-guide portion whose inclination is reversed into an upward and rearward direction, thus facing inwardly toward the product display space in contradistinction to the corresponding feature shown in FIG. 32 and in preceding embodiments.

These optional features of a rearwardly-projecting air guide and/or a rearwardly-facing RAG 7 are oriented, positioned and arranged to capture the coldest air from the air curtain 9 and to separate unwanted warm air from the air curtain 9 flow, in addition to capturing any cold air that will tend to spill out of the product display space from its bottom front corner. As before, the rearwardly projecting air guide may have anti-condensation features such as insulation and/or heating; also, its position, size and orientation make it particularly useful for displaying pricing, promotional material and other information.

The embodiments of the invention described above design-out supporting airflow such as back panel flow. The invention reduces the height of the air curtain 9 to generate a stable, unsupported air curtain 9 with a desirable discharge velocity and thickness. By designing out back panel flow, a display cabinet of the invention is expected to reduce the range of temperatures measured in stored product items from 8.6 K typical in conventional, vertical open-fronted refrigerated display cabinets to around 4 K whilst maintaining the open front without doors.

Whilst supplementary or supporting air flow such as back panel flow is not required in the present invention, its use is not excluded as such in the broadest concept of the invention. In situations where the cabinet has a significant heat gain through, for example, a glass end wall or side wall, some supplementary cooling may be useful. Such cooling may conveniently be provided where it is needed by localised application of cold air bled from the air ducts or from a shelf that supply the air curtain 9. However the primary purpose of such supplementary air flow is cooling and not support for the air curtain 9.

It should be noted in this respect that in view of the air circulation around the top, bottom, front and back surfaces, significant conductive heat gain is only possible through the left and right side panels. The likely spot-cooling requirement to offset such heat gains will be minimal and should not exceed 5% of air curtain flow. Any such spot-cooling should be introduced evenly and preferably vertically along the face of the surface in proportion to the heat gain. Spot-cooling vertically along a side panel may therefore be from a series of very small holes or narrow linear slots aligned with the heat gain.

It is preferred to avoid introducing supplementary air flow from the rear due to the likelihood of over-cooling items in the product display space. Additionally it is best to avoid introducing additional air at a forward position near the air curtain as this may disrupt the air curtain dynamics.

It will be recalled from FIG. 31 that a multi-cell appliance with the cells in plural columns suitably has partitions between neighbouring columns to reduce disturbance between neighbouring air curtains 9. FIG. 41 shows that if the shelves 21 of neighbouring columns are aligned—as can be seen in the two columns on the right—a partition between those columns may be removed to increase the effective display area of each shelf. However, if some shelves of those neighbouring columns are aligned and other shelves of those columns are not aligned—see, for example, the non-aligned top shelves in the two columns on the right in FIG. 42—a mini-partition may be created between those columns at the level of the non-aligned shelves. This leaves no partition between the lower shelves that are aligned, to the benefit of their effective display area.

FIGS. 43 and 44 show possible alternative arrangements for mini-partitions supported by shelves 21 of neighbouring columns. Both arrangements allow for variations in the vertical gap between the shelves.

The arrangement in FIG. 43 comprises a roller blind 237 attached to an edge of one shelf and extending from there to an adjacent vertically-offset edge of another shelf, which may be in the same column or in an adjacent column. The roller blind 237 can extend or retract to suit the vertical gap between the shelves 21.

The arrangement in FIG. 44 comprises overlapping leaves or plates 337, 339, one attached to each vertically-offset shelf 21, which shelves again may be in the same column or in adjacent columns. The leaves 337, 339 lie face-to-face and can slide together or apart to adjust the height of the mini-partition to suit the vertical gap between the shelves.

Mini-partitions could of course be supported wholly or partially by the back inner wall of the unit as an alternative, and simpler clip-on panel arrangements could be used if the facility for gap adjustment is not required.

Referring finally to FIGS. 45 to 48, these show variants of a fourth embodiment of the invention in which one or more airflow-managed cells have one or more sloping shelves 23. The sloping shelves 23 are substantially inclined to the horizontal, angled downwardly from the back of the unit toward the front. This better displays certain products and may be particularly useful for the display of fruit and vegetables as in current standard retail refrigeration. Suitable product-holding formations may be added to the sloping shelves 23 to segregate items and to stop them rolling or sliding forward out of the product display space.

Airflow-managed cells with sloping shelves 23 of the fourth embodiment may have all of the attributes of regular airflow-managed cells with substantially horizontal shelves, described previously. For example, they may be part of single-cell standalone units with insulation top and bottom, and they may be served by ducted remote cooling.

FIG. 46 shows that an intermediate shelf 21 may again be used within the chilled cavity of an airflow-managed cell having a sloping shelf 23. That intermediate shelf 21 may again be perforated or of wire. FIG. 47 shows how airflow-managed cells with sloping shelves may be stacked in an appliance within a shared surrounding insulated cabinet, whereas FIG. 48 shows an appliance with a mix of airflow-managed cells, some cells having sloping shelves 23 and others having substantially horizontal shelves.

FIGS. 49 to 51 illustrate optional measures to counter infiltration of ambient air that tends to occur around the sides of an air curtain 9 where the seal is lost.

FIG. 49 shows side finishers 161 that extend inwardly from the side walls 37 of a refrigerated display unit 1 and so extend down each side of the air curtain 9, slightly forward of the air curtain 9. These side finishers 161 may be insulated and/or heated, and/or may have a high-emissivity finish to combat condensation and icing. The air curtain 9 is thereby protected from ambient air attack directly at its side edges.

FIG. 50 shows that a similar partition finisher 163 may be provided, overlapping and extending laterally from the front edge of a partition that divides airflow-managed cells into columns. Again, the partition finisher 163 is suitably insulated and/or heated and/or has a high-emissivity finish to combat condensation and icing. FIG. 51 shows an alternative approach which is to keep the front edge of the partition 137 behind the adjacent air curtains 9, where it is protected from condensation and icing, but this is less preferred as it may allow unwanted interaction between those air curtains 9.

Symmetry, balance and airtightness are important aspects of the airflow-managed cells used in the invention. Symmetry arises to a considerable extent from the advantageous modularity of the design, which applies equally where rear duct distribution is used.

All embodiments of the invention suitably have means for balancing, tuning or adjusting airflows and temperatures for optimum performance, versatility and adaptability. For example, the pressures in the supply and return distribution ducts may change depending on the number of shelves and the distance between the shelves (which may of course vary), potentially affecting the performance of the unit. Optimum performance requires the pressure in the supply and return ducts to be balanced. A differential pressure sensor 301 may therefore be provided as shown in FIG. 52 to read and compare the pressures in both ducts 41, 45 and to send a signal to a controller 303 to adjust the speed of a fan to make sure that the system is balanced.

More generally, airflow balancing and demand management could be controlled by an automated system. In this case, variable speed/volume fans, valves or dampers could be used to regulate and balance airflows between shelves using temperature, pressure and/or flow measuring devices placed at suitable points such as 'throats' in ducts. For example, valves such as butterfly valves or sliding shutters may be provided in individual shelves, or otherwise associated with individual shelves, to regulate the air flow. Such valves or shutters may have to be adjusted depending on the distance to the shelf below and the temperature desired for the airflow-managed cell of the shelf below. Their adjustment could be manual or electronic.

Testing has shown that static pressure losses in the vertical riser ducts are insignificant in comparison with the static losses in the shelves and in the throats leading to or within the shelves. Consequently, the relative positions of different shelves along the riser ducts will have little bearing on the system balance. This means that air will be delivered substantially equally to/from each shelf regardless of its vertical position along the riser ducts.

Table 1 appended to this specification sets out some preferred criteria, and values for each criterion, for air curtains and appliances in accordance with the invention. In Table 1, criterion preferences are ranked by the numerals 1, 2 and 3, with 1 representing most preferred values; 2 representing less preferred values; and 3 representing acceptable but least preferred values for each criterion.

For either a turbulent DAG or a narrow DAG, the centreline discharge velocity may decay within one DAG width away from the discharge face of the DAG. So, if measuring the discharge velocity at the DAG on its centreline, the measuring point should be as close to the discharge face of the DAG as possible. Alternatively, as discharge velocity will vary across the width and length of the DAG, it may be defined more accurately as the bulk mean velocity, calculated by dividing the total volume flow of air at the DAG by the cross-sectional area of the DAG.

Like other values expressed previously in this specification, the values in Table 1 relate to chiller units that are designed to store products a few degrees above zero Celsius. Chiller units are distinguished from freezer units, which are designed to store products several degrees below zero Celsius. In the case of freezer units, there is a preference for:

- wider DAG slot widths of say 100 mm to 150 mm as the temperature rise may be too great with a slot as narrow as 70 mm;
- faster discharge velocity—by way of contrast, a discharge velocity of 1 m/s in a freezer unit roughly equates to a discharge velocity of 0.7 m/s in a chiller unit in terms of balancing convective cooling and radiation heat gain;
- shorter air curtain heights, not much greater than 300 mm. Secondary curtains and/or some supporting bleed air may be necessary for taller access openings 39 in freezer applications In general, lower Richardson Numbers are better suited to freezer units or at least the Richardson Numbers for freezer units tend to be lower than those for chiller units. Richardson Number values may be as low as 2 for freezer units, but values in the range 5 to 10 are preferred. The height of the air curtain 9 is regarded as the dominant variable and so this difference in Richardson Number may simply reflect that a chiller unit can typically work with a taller curtain than can be used with a freezer unit.

Minimising entrainment and infiltration provides the key to tight temperature control and energy efficiency with the designs of the present invention. Good practice is required when specifying air ducts and grilles to minimise turbulence. Careful balancing of the velocity profiles across the width of the cabinet at both DAG and RAG will also minimise infiltration. Where infiltration is high due to an imbalance between air discharge and return, both efficiency and product temperature will suffer.

In conclusion, the present invention provides solutions by cooling airflow management techniques that individually or in combination reduce the accumulated losses that occur in conventional open refrigerated display cabinets. Optional and essential features and benefits of the invention include:

- Compartmentalisation of large open-fronted display areas into airflow-managed cells between horizontal sections/shelves, and vertically between stacks of shelves where that is appropriate for retailing purposes.
- Airflow-managed curtains provide correct dynamics to effectively and efficiently seal the front of an airflow-managed cell such that entrainment and heat gain by radiation is minimised.
- The airflow-managed cells are designed to parameters to control air circulation, air distribution, air turbulence, air buoyancy, and the stack effect. They maintain tight temperature control and minimal infiltration regardless of product type or stacking within the product display space.
- Adjacent airflow-managed cells may be maintained at different temperatures to best suit the items stored.
- Modular appliances defining respective airflow-managed cells may be used to distribute chilled and frozen products more conveniently around a retail environment. This allows great flexibility in display size and configuration by combining modules in various stacked and side-by-side combinations.
- Appliances in accordance with the invention could even be used for the display of frozen products due to low infiltration rates and tight temperature control. Ice loadings on evaporator will be lighter than in normal open cabinets due to low infiltration.
- The improvements of the invention may be retrofitted as an upgrade to provide the benefits of airflow-managed cells to existing refrigerated display cabinets.

The invention claimed is:

1. A refrigerated display unit, comprising:

an open-fronted cabinet containing a product display space accessible through an access opening defined by the open front;

a cooling means for introducing or producing cold air to refrigerate items in the product display space in use;

at least one forwardly-positioned discharge outlet communicating with a supply duct for, in use, projecting cold air with a discharge velocity as an air curtain across the access opening, which discharge outlet has an effective width that determines an air curtain thickness; and at least one forwardly-positioned return inlet communicating with a return duct for, in use, receiving air from the air curtain, such that spacing between the discharge outlet and the return inlet determines an air curtain height;

wherein the supply duct and the return duct together extend around the product display space to define a recirculation path between the return inlet and the discharge outlet, the supply duct and the return duct lying behind inner panels that define the product display space to provide supplementary cooling to the product display space by cooling the inner panels;

wherein the discharge velocity, as measured at a point 25 mm below the discharge outlet, is between 0.1 m/s and 1.5 m/s;

the air curtain height is less than ten times the air curtain thickness;

the air curtain is substantially unsupported by any supplementary cooling airflow supplied into the product display space separately from the air curtain; and at least one inner panel is at least partially insulated, heated or of low conductivity to reduce local supplementary cooling to the product display space.

2. The unit of claim 1, wherein the mass flow rate of any supplementary cooling airflow is less than 5% of the mass flow rate of the cold air projected from the discharge outlet to form the air curtain.

3. The unit of claim 1, wherein substantially no supplementary cooling airflow is supplied into the product display space.

4. The unit of claim 1, wherein any supplementary cooling airflow is supplied into the product display space substantially only at a location spaced between the access opening and a back inner panel of the product display space.

5. The unit of claim 4, wherein supplementary cooling airflow is supplied in the region of a side inner panel of the product display space.

6. The unit of claim 5, wherein supplementary cooling airflow is supplied from a shelf in the cabinet.

7. The unit of claim 1 further comprising at least one finisher extending laterally in front of the discharge outlet and/or the return inlet, said at least one finisher being insulated, heated, of low-conductivity material and/or with a low-emissivity finish.

8. The unit of claim 7, wherein at least one finisher influences airflow discharged from the discharge outlet or received by the return inlet.

9. The unit of claim 8, wherein a finisher in front of the discharge outlet has a lower edge that lies below a discharge face of the discharge outlet.

10. The unit of claim 8, wherein a finisher in front of the return inlet has an upper portion that extends above an intake face of the return inlet.

11. The unit of claim 10, wherein the upper portion of that finisher is inclined upwardly and forwardly away from the product display space.

12. The unit of claim 10, and having an upstanding riser on a rear side of the return inlet.

13. The unit of claim 12, wherein the riser and the opposed upper portion of the finisher cooperate to channel air from the air curtain into the return inlet.

14. The unit of claim 10, wherein the upper portion of that finisher is inclined upwardly and rearwardly toward the product display space.

15. The unit of claim 1, being adapted to generate a velocity profile that varies across the thickness of the air curtain, with faster airflow on the side of the curtain facing the product display space.

16. The unit of claim 1, further comprising upright finishers that are disposed in front of the air curtain along sides of the air curtain and extend inwardly across the access opening.

17. The unit of claim 1, further comprising a differential pressure sensor arranged to compare pressures in the supply and return duct; and a controller responsive to a signal from the sensor to control the unit in accordance with the signal to modify relative pressures in the ducts.

18. The unit of claim 1, further comprising:

an open-fronted cabinet defining a cold-storage volume; and at least one shelf disposed in the cold-storage volume for supporting refrigerated items in use;

wherein the shelf defines an upper access opening above the shelf and a lower access opening below the shelf affording access to refrigerated items in respective product display spaces in the cold-storage volume above and below the shelf, and the shelf has:

at least one forwardly-positioned discharge outlet communicating with a supply duct for, in use, projecting cold air as an air curtain across the lower access opening; and at least one forwardly-positioned return inlet communicating with a return duct for, in use, receiving air from another air curtain discharged above the shelf across the upper access opening.

19. The unit of claim 18, wherein said shelves are arranged in a vertical array and wherein a plurality of vertical arrays of shelves are arranged into side-by-side columns.

20. The unit of claim 19, comprising at least one partition between shelves of adjacent columns.

21. The unit of claim 20, wherein at least a front edge of the partition is insulated, heated, of low-conductivity material and/or with a low-emissivity finish.

22. The unit of claim 18, wherein said at least one shelf is bounded to the sides by at least one partition and/or by at least one side wall of the cabinet, and wherein the partition or side wall extends forwardly beyond the shelf.

23. The unit of claim 22, wherein a finisher that is insulated, heated, of low-conductivity material and/or with a low-emissivity finish on front of the shelf extends from the partition or side wall on one side of the shelf to the partition or side wall on the other side of the shelf.

* * * * *